US012397390B2

(12) United States Patent
Sitter et al.

(10) Patent No.: US 12,397,390 B2
(45) Date of Patent: Aug. 26, 2025

(54) BELT SANDER

(71) Applicant: MILWAUKEE ELECTRIC TOOL CORPORATION, Brookfield, WI (US)

(72) Inventors: James C. Sitter, Milwaukee, WI (US); Jeffrey S. Holly, West Bend, WI (US); Joseph G. Bloomfield, Wauwatosa, WI (US); David A. Bierdeman, New Berlin, WI (US); Logan M. Hietpas, Glendale, WI (US); Adam N. Carter, Milwaukee, WI (US); Nikos A. Gainacopulos, Milwaukee, WI (US); Eric K. Farrington, Grafton, WI (US); Christopher M. Didier, Milwaukee, WI (US); Benjamin J. Ludy, Jackson, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 345 days.

(21) Appl. No.: 17/717,503

(22) Filed: Apr. 11, 2022

(65) Prior Publication Data

US 2022/0324079 A1 Oct. 13, 2022

Related U.S. Application Data

(60) Provisional application No. 63/301,212, filed on Jan. 20, 2022, provisional application No. 63/274,789, (Continued)

(51) Int. Cl.
*B24B 23/06* (2006.01)

(52) U.S. Cl.
CPC ..... *B24B 23/06* (2013.01)

(58) Field of Classification Search
CPC ..... B24B 23/06; B24B 21/06; B24B 21/10; B24B 21/12; B24B 21/14; B24B 7/188; (Continued)

(56) References Cited

U.S. PATENT DOCUMENTS 6,047,693 A 4/2000 Yamami et al.
6,514,131 B1 2/2003 Reich et al.
(Continued)

FOREIGN PATENT DOCUMENTS

CN 203738543 U 7/2014
CN 204565841 U 8/2015
(Continued)

OTHER PUBLICATIONS

Ridgid (Ridgid Gen5X 18V Cordless Belt Sander) Published on Jan. 6, 2017 at Ridgid Gen5X 18V Cordless Belt Sander—YouTube) https://www.youtube.com/watch?v=ZgA5Ow2fZR8 (Year: 2017).*
(Continued)

*Primary Examiner* — Eric J Rosen
*Assistant Examiner* — John C Merino
(74) *Attorney, Agent, or Firm* — Michael Best & Friedrich LLP

(57) ABSTRACT

A belt sander for sanding a workpiece and defining a center of gravity within a first plane. The belt sander includes a housing, a handle defining a second plane, and a drive unit disposed within the housing. The drive unit includes a motor disposed adjacent a first sidewall of the housing, a pulley system disposed adjacent a second sidewall of the housing opposite the first sidewall, and a transmission disposed between the motor and the pulley system. The belt sander further includes a belt drive system driven by the drive unit and including a drive wheel, a driven wheel, and a platen. The platen defines a third plane extending perpendicular therefrom. The transmission and pulley system are disposed
(Continued)

on one side of the first plane and the motor is disposed on an opposite side of the first plane. The motor is intersected by the second and third planes.

17 Claims, 19 Drawing Sheets

Related U.S. Application Data filed on Nov. 2, 2021, provisional application No. 63/246,655, filed on Sep. 21, 2021, provisional application No. 63/173,545, filed on Apr. 12, 2021.

(58) Field of Classification Search
CPC . B25F 5/026; B25F 5/02; B23D 51/01; B25G 1/102
See application file for complete search history.

(56) References Cited

U.S. PATENT DOCUMENTS

| | | | |
|---|---|---|---|
| 6,565,425 | B1 | 5/2003 | Wuensch |
| 6,641,634 | B2 | 11/2003 | Reich et al. |
| 7,101,274 | B1 | 9/2006 | Etter et al. |
| 7,118,609 | B2 | 10/2006 | Valentini |
| D546,156 | S | 7/2007 | Aglassinger et al. |
| 7,338,348 | B2 | 3/2008 | Melvin et al. |
| 7,497,886 | B2 | 3/2009 | Walker |
| 7,553,217 | B2 | 6/2009 | Reich et al. |
| 7,799,104 | B2 | 9/2010 | Valentini |
| 7,976,363 | B2 | 7/2011 | Reich et al. |
| 8,070,845 | B2 | 12/2011 | Roehm |
| 2005/0272356 | A1* | 12/2005 | Walker ..... B24B 23/06 451/355 |
| 2005/0272357 | A1 | 12/2005 | Walker |
| 2008/0153406 | A1 | 6/2008 | Melvin et al. |
| 2010/0003905 | A1 | 1/2010 | Yamashiro et al. |
| 2015/0314413 | A1* | 11/2015 | Roeck ..... B24B 23/02 451/344 |

FOREIGN PATENT DOCUMENTS

| | | | |
|---|---|---|---|
| CN | 207736068 | U | 8/2018 |
| CN | 212330623 | U | 1/2021 |
| CN | 212553186 | U | 2/2021 |
| DE | 3401564 | C2 | 6/1988 |
| DE | 19831383 | A1 | 1/2000 |
| DE | 10246057 | A1 | 4/2004 |
| DE | 10251564 | A1 | 5/2004 |
| DE | 102007033216 | A1 | 1/2009 |
| DE | 102015225365 | A1 | 6/2017 |
| DE | 102016105330 | A1 | 9/2017 |
| EP | 1247612 | B1 | 8/2007 |
| EP | 1125698 | B1 | 6/2012 |
| EP | 3235603 | B1 | 4/2020 |
| JP | 2005288689 | A | 10/2005 |
| WO | 2003026840 | A1 | 4/2003 |

OTHER PUBLICATIONS

International Search Report and Written Opinion for Application No. PCT/US2022/024223 dated Aug. 31, 2022 (15 pages).

* cited by examiner

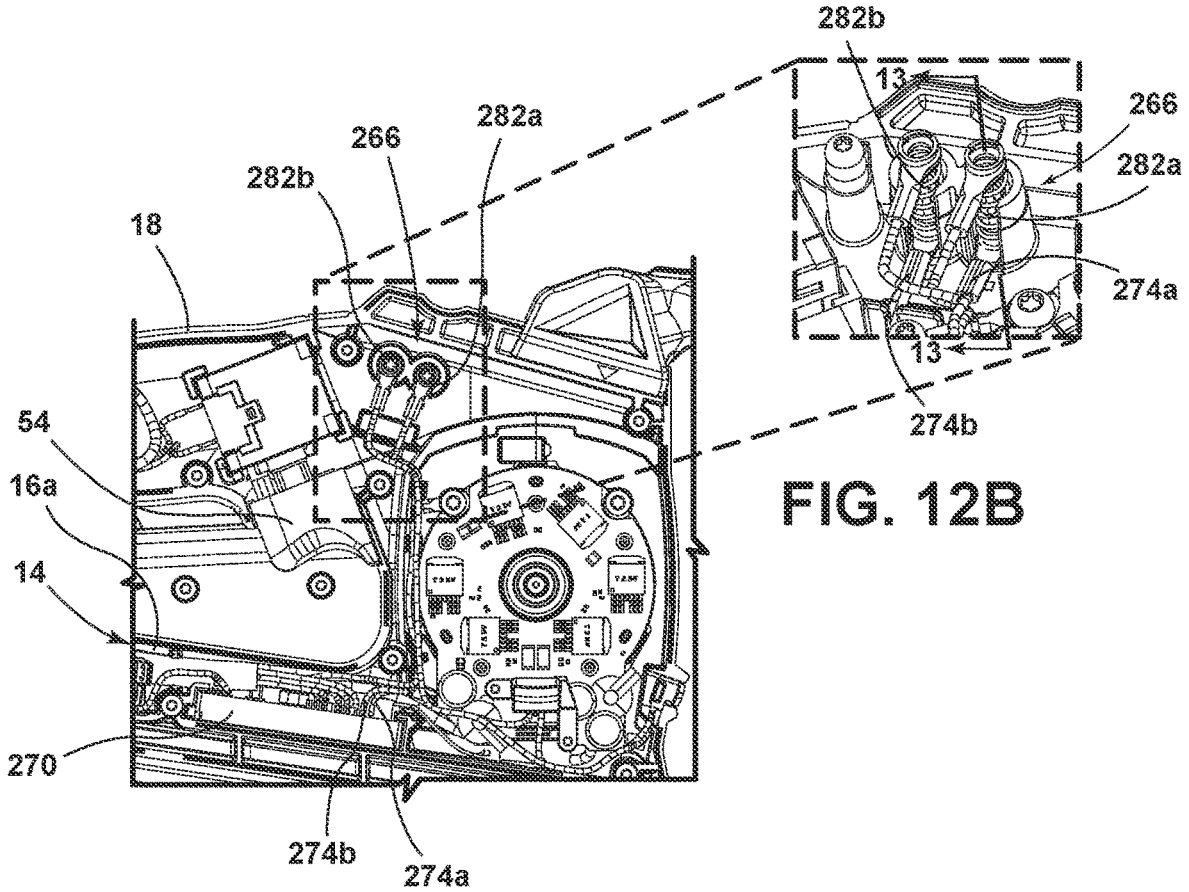
FIG. 12B
FIG. 12A
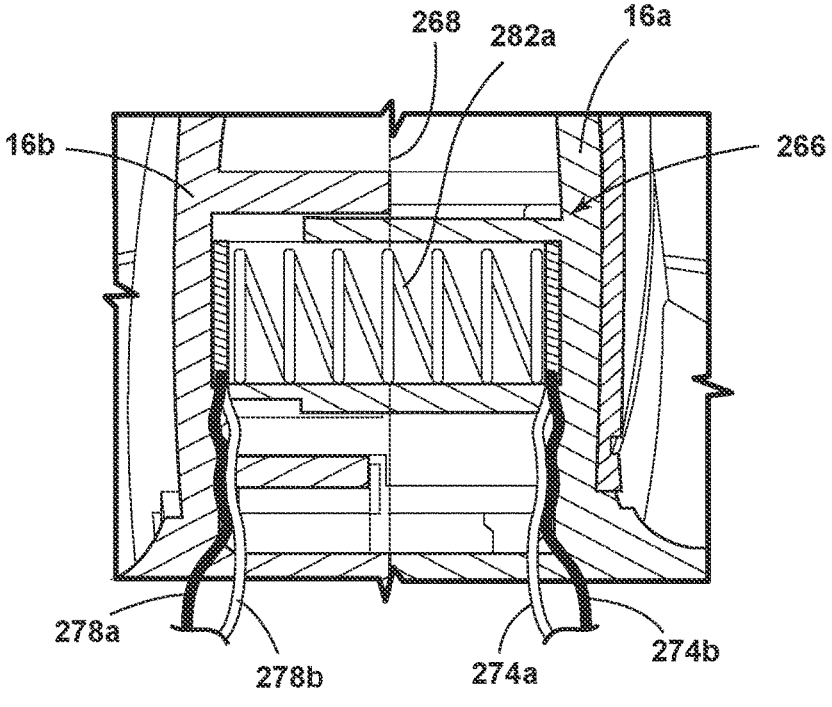
FIG. 13

BELT SANDER

CROSS-REFERENCE TO RELATED APPLICATIONS

This application claims priority to U.S. Provisional Patent Application No. 63/301,212, filed Jan. 20, 2022, U.S. Provisional Patent Application No. 63/274,789, filed Nov. 2, 2021, U.S. Provisional Patent Application No. 63/246,655, filed Sep. 21, 2021, and U.S. Provisional Patent Application No. 63/173,545, filed Apr. 12, 2021, the entire contents of each of which are incorporated by reference herein.

FIELD OF THE INVENTION

The present invention relates to power tools, and in particular to portable belt sanders.

BACKGROUND OF THE INVENTION

Belt sanders generally include an abrasive sanding belt that is driven in a continuous loop. Typically, there is a series of drums that drive the sanding belt in a continuous loop, where the drums are spaced apart to create lateral runs therebetween. One of the lateral runs can be pressed against a workpiece to perform a sanding operation.

SUMMARY OF THE INVENTION

In one embodiment, the invention provides, among other things, a belt sander for sanding a workpiece and defining a center of gravity within a first plane. The belt sander includes a main housing, a handle defining a second plane, and a drive unit disposed within the main housing. The drive unit includes a motor disposed adjacent a first lateral sidewall of the main housing, a pulley system disposed adjacent a second lateral sidewall of the main housing opposite the first lateral sidewall, and a transmission disposed between the motor and the pulley system. The belt sander further includes a belt drive system driven by the drive unit. The belt drive system includes a drive wheel that is driven by the pulley system, a driven wheel that is driven by the drive wheel via a sanding belt, and a platen disposed between the drive wheel and the driven wheel to press the sanding belt against a workpiece. The platen defines a third plane extending perpendicular therefrom. The transmission and pulley system are disposed on one side of the first plane and the motor is disposed on an opposite side of the first plane. The motor is intersected by the second plane and the third plane.

In another embodiment, the invention provides, among other things, a belt sander for sanding a workpiece including a handle, and a main housing having a first lateral sidewall, a second lateral sidewall opposite the first lateral sidewall, and a front end being perpendicular to the first lateral sidewall. The belt sander further includes a drive unit disposed within the main housing between the first lateral sidewall and the second lateral sidewall, and a belt drive system driven by the drive unit. The belt drive system has a drive wheel, a driven wheel, and a sanding belt for engaging the workpiece. The belt sander further includes a first light disposed on the first lateral sidewall and a first lens for projecting light onto a first area of the workpiece that runs alongside the first lateral sidewall. The belt sander further includes a second light disposed on the front end and a second lens for projecting light onto a second area of the workpiece that is adjacent the driven wheel.

In yet another embodiment, the invention provides, among other things, a belt sander for sanding a workpiece including a main housing, a handle extending from the main housing, a drive unit disposed within the main housing, a battery for selectively supplying electrical power to the drive unit, and a belt drive system driven by the drive unit. The belt drive system has a drive wheel, a driven wheel driven by the drive wheel via a sanding belt, and a platen for pressing the sanding belt against a workpiece while the sanding belt is rotated about the drive wheel and the driven wheel, creating dust and debris from the workpiece. The belt sander further includes a dust extraction unit driven by the motor transporting dust and debris away from the workpiece, and a dust bag positioned downstream of the dust extraction unit to receive dust and debris therefrom. The dust bag has a rectangular shape, and wherein the dust bag includes a zipper extending along first and second edges of the dust bag.

In still another embodiment, the invention provides, among other things, a belt sander for sanding a workpiece including a handle, a main housing having a first clamshell half and a second clamshell half that are secured together along a joint to form the main housing, a drive unit disposed within the main housing, and a battery for selectively supplying electrical power to the drive unit. The belt sander further includes a belt drive system driven by the drive unit. The belt drive system has a drive wheel, a driven wheel, and a sanding belt for engaging the workpiece. The belt sander further includes a first wire disposed within the first clamshell half and a second wire disposed within the second clamshell half. The first and second wires conduct electrical current from the battery to components within the belt sander. The belt sander further includes a wiring bridge that spans the joint between the first and second clamshell halves to electrically connect the first wire and the second wire. The wiring bridge is compressed when the first and second clamshell halves are coupled together.

In still yet another embodiment, the invention provides, among other things, a belt sander for sanding a workpiece including a main housing, a handle extending from the main housing, a drive unit disposed within the main housing, a battery for selectively supplying electrical power to the drive unit, and a first pulley system driven by the drive unit and having a first belt tensioner that is biased against a first pulley belt to remove excess slack from the first pulley belt. The belt sander further includes a belt drive system driven by the first pulley system and having a drive wheel, a driven wheel driven by the drive wheel via a sanding belt, and a platen for pressing the sanding belt against a workpiece while the sanding belt is rotated about the drive wheel and the driven wheel, creating dust and debris from the workpiece. The belt sander further includes a second pulley system driven by the drive unit and having a second belt tensioner that is biased against a second pulley belt to remove excess slack from the second pulley belt. The belt sander further includes a dust extraction unit driven by the second pulley system for transporting dust and debris away from the workpiece.

In still yet another embodiment, the invention provides, among other things, a belt sander for sanding a workpiece including a main housing, a handle extending from the main housing, a drive unit disposed within the main housing and including a motor that drives a drive shaft about a drive axis, and a battery for selectively supplying electrical power to the drive unit. The belt sander further includes a pulley system having a first pulley coupled to and driven by the drive shaft of the motor and a second pulley driven by the first pulley via a pulley belt. The belt sander further includes a belt drive system driven by the pulley system and having a drive wheel, a driven wheel driven by the drive wheel via a sanding belt, and a platen for pressing the sanding belt against a workpiece while the sanding belt is rotated about the drive wheel and the driven wheel. The belt sander further includes a belt tensioner for removing excess slack from the pulley belt, wherein the belt tensioner is capable of moving the first pulley relative to the second pulley during an adjustment state and inhibiting the first pulley from moving relative to the second pulley when the pulley belt is sufficiently tensioned during a locked state.

In still yet another embodiment, the invention provides, among other things, a belt sander for sanding a workpiece including a main housing, a handle extending from the main housing, a drive unit disposed within the main housing, a battery for selectively supplying electrical power to the drive unit, and a belt drive system driven by the drive unit. The belt drive system has a drive wheel, a driven wheel driven by the drive wheel via a sanding belt, and a platen defining a front edge disposed adjacent the driven wheel, a rear edge disposed adjacent the drive wheel, a bottom side disposed adjacent the workpiece, and a top side opposite the bottom side. The belt sander further includes a platen attachment that is removably coupled to the platen and is configured to press the sanding belt against a workpiece while the sanding belt is rotated about the drive wheel and the driven wheel. The platen attachment includes a lip that bends around at least one of the front edge or the rear edge from the bottom side to the top side, wherein the lip is coupled to the top side of the platen.

In still yet another embodiment, the invention provides, among other things, a belt sander for sanding a workpiece including a main housing, a handle extending from the main housing, a drive unit disposed within the main housing, a battery for selectively supplying electrical power to the drive unit, and a belt drive system driven by the drive unit. The belt drive system has a drive wheel, a driven wheel driven by the drive wheel via a sanding belt, and a platen defining a front edge disposed adjacent the driven wheel, a rear edge disposed adjacent the drive wheel, a bottom side disposed adjacent the workpiece, and a top side opposite the bottom side. The belt sander further includes a platen attachment that is removably coupled to the platen and is configured to press the sanding belt against a workpiece while the sanding belt is rotated about the drive wheel and the driven wheel. The belt sander further includes a wear skid that is removably coupled to the rear edge of the platen and protrudes beyond the platen attachment. The wear skid extends into the path of the sanding belt between the drive wheel and the platen attachment.

In still yet another embodiment, the invention provides, among other things, a belt sander for sanding a workpiece including a main housing, a handle extending from the main housing, a drive unit disposed within the main housing, a battery for selectively supplying electrical power to the drive unit, and a pulley system driven by the drive unit. The pulley system includes a first pulley, a second pulley, and a pulley belt having an upper run and a lower run. The belt sander further includes a vibration dampening system disposed adjacent to and selectively engaging the pulley system to inhibit oscillations within the pulley belt. The vibration dampening system includes at least one wave disruptor positioned away from outer periphery of the pulley belt, such that the pulley belt contacts the at least one wave disruptor when the upper run or the lower run of the pulley belt deviates from a straight-line path.

Other aspects of the invention will become apparent by consideration of the detailed description and accompanying drawings.

BRIEF DESCRIPTION OF THE DRAWINGS

FIG. 12A is a cross-section view of the main housing taken along line 6-6 of FIG. 5, illustrating a wiring bridge.

FIG. 12B is an enlarged perspective view of FIG. 12A, illustrating the wiring bridge.

FIG. 13 is a cross-sectional view of the wiring bridge taking along line 13-13 of FIG. 12B.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
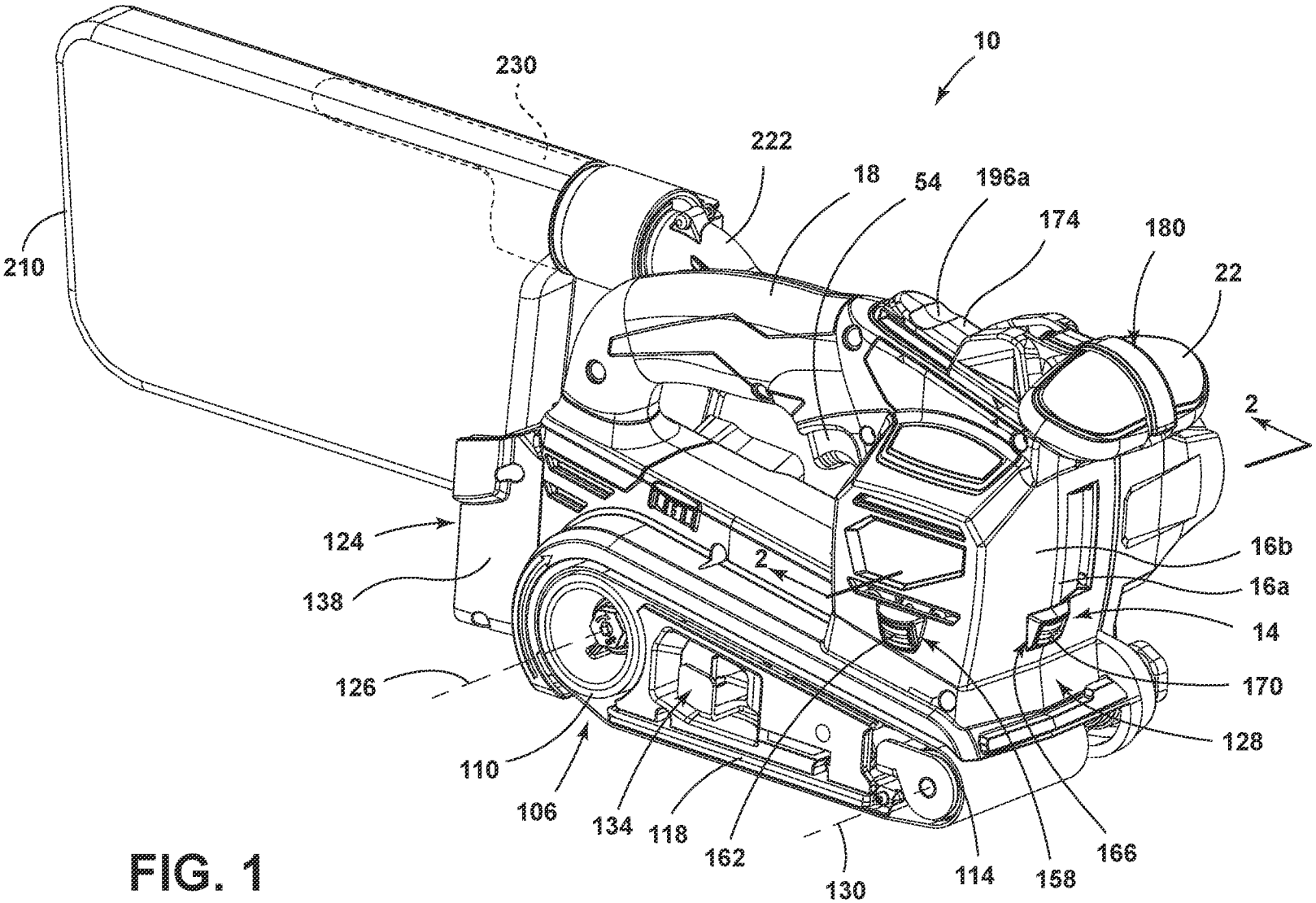
FIG. 1 is a perspective view of a belt sander according to an embodiment of the invention.

FIG. 1 illustrates a portable power tool, such as a belt sander 10, for sanding a workpiece. In the illustrated embodiment, the belt sander 10 includes a main housing 14, a main frame 20 (FIG. 3) that supports the main housing 14, a primary handle 18 used for gripping and maneuvering the sander 10 along a workpiece, and a pommel or secondary handle 22 that is selectively grasped by a user to further stabilize the sander 10 during operation. The main housing 14 is comprised of two clamshell halves 16*a*, 16*b* that are connected together with threaded fasteners (e.g., screws), but may alternatively be secured together using other suitable coupling means.

Figure 2:
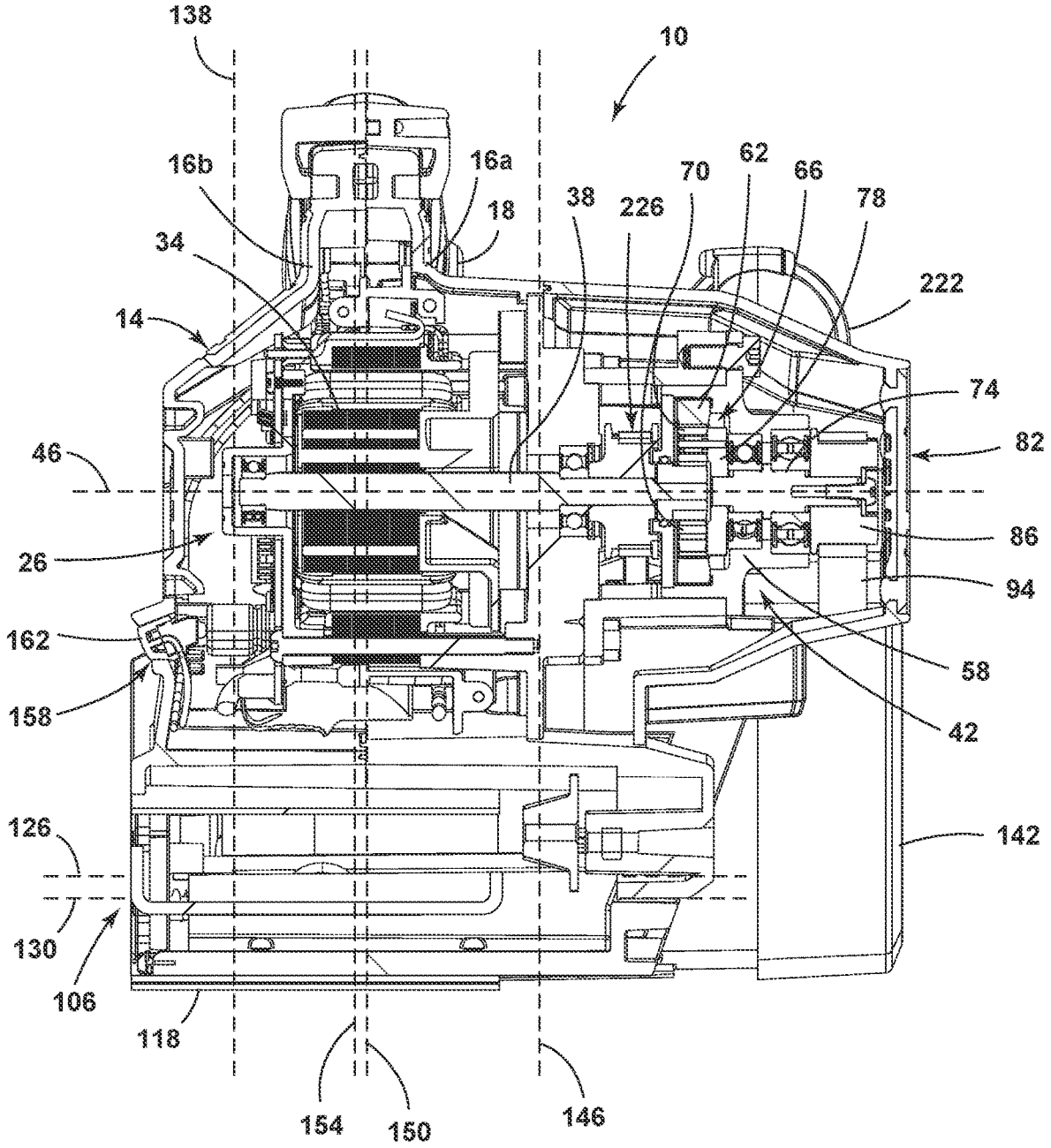
FIG. 2 is a cross-sectional view of a drive unit within a main housing of the belt sander, taken along line 2-2 of FIG. 1.
Figure 4:
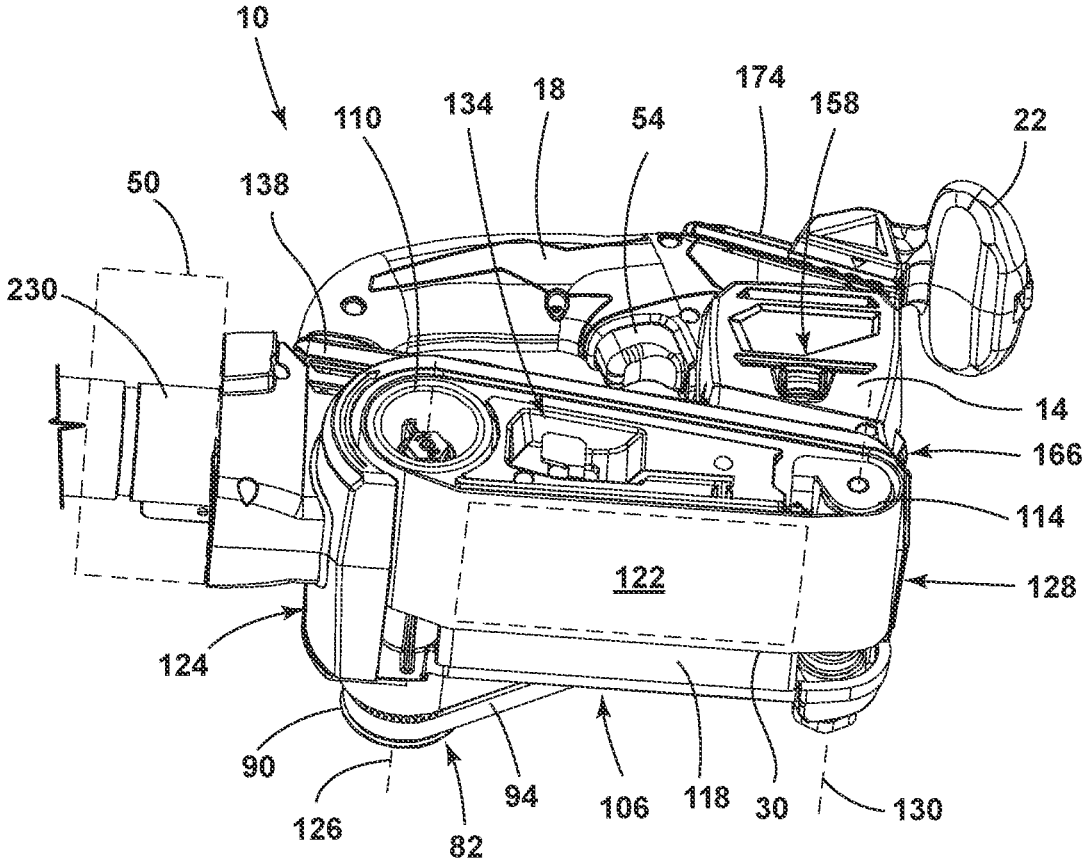
FIG. 4 is a bottom perspective view of the belt sander of FIG. 1, illustrating a sanding belt disposed around a drive wheel, a driven wheel, and a platen.
Figure 5:
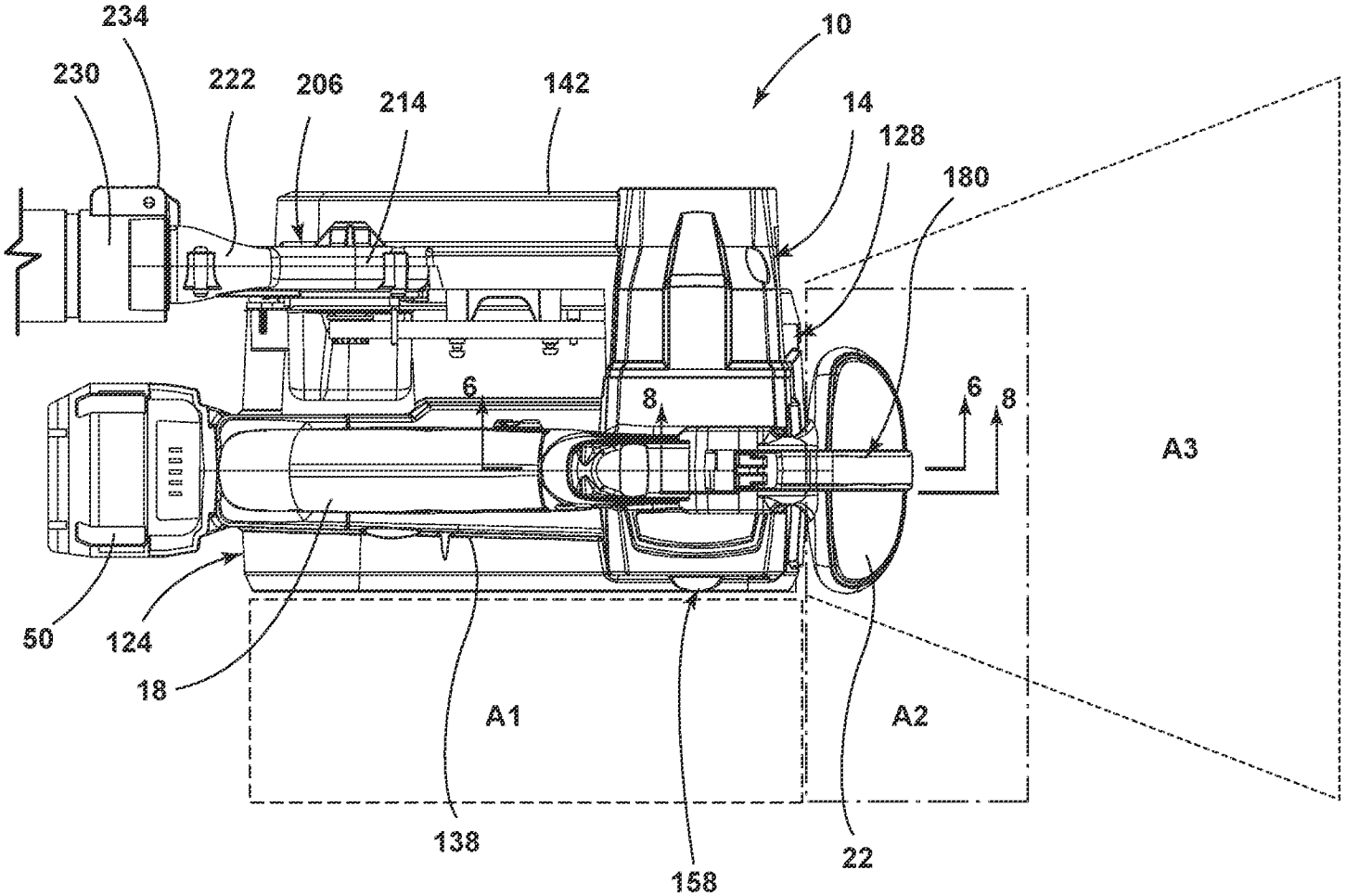
FIG. 5 is a top plan view of the belt sander of FIG. 1, illustrating areas that are illuminated by work lights.

With reference to FIGS. 1 and 2, the belt sander 10 further includes a drive unit 26 that is positioned within the main housing 14 and operable to drive a sanding belt 30 (FIG. 4). Specifically, the drive unit 26 includes an electric motor 34 (e.g., a brushless DC electric motor) capable of producing a rotational output through a drive shaft 38 which, in turn, provides a rotational input to a transmission 42. The motor 34 defines a motor axis 46 along which the drive shaft 38 and the transmission 42 are coaxially aligned. The belt sander 10 is powered by a battery pack 50, as shown in FIG. 5. The battery pack 50 connects to the primary handle 18 and provides electrical power to the motor 34 when a trigger 54 is depressed. The trigger 54 is conveniently positioned adjacent the primary handle 18 to allow a user to maneuver and activate the belt sander 10 with a single hand.

With reference to FIG. 2, the transmission 42 includes a transmission housing 58 affixed to the main frame 20, a single planetary gear stage 66 including a ring gear 62 positioned within the transmission housing 58 and three planetary gears 70 intermeshed with the ring gear 62. An output shaft 74 is coupled for co-rotation with a carrier 78 in the planetary gear stage 66 to thereby receive the torque output of the transmission 42. The output shaft 74 is coaxial with the motor axis 46. In other embodiments, the ring gear 62 receives the torque output of the transmission 42 to drive the output shaft 74. Although the transmission 42 of the illustrated embodiment includes a single planetary gear stage 66, in other embodiments, the transmission 42 may alternatively include two or more planetary gear stages. Still in other embodiments, the transmission 42 may alternatively include one or more spur gear sets, one or more helical gear sets, or other styles of transmissions.

Figure 3:
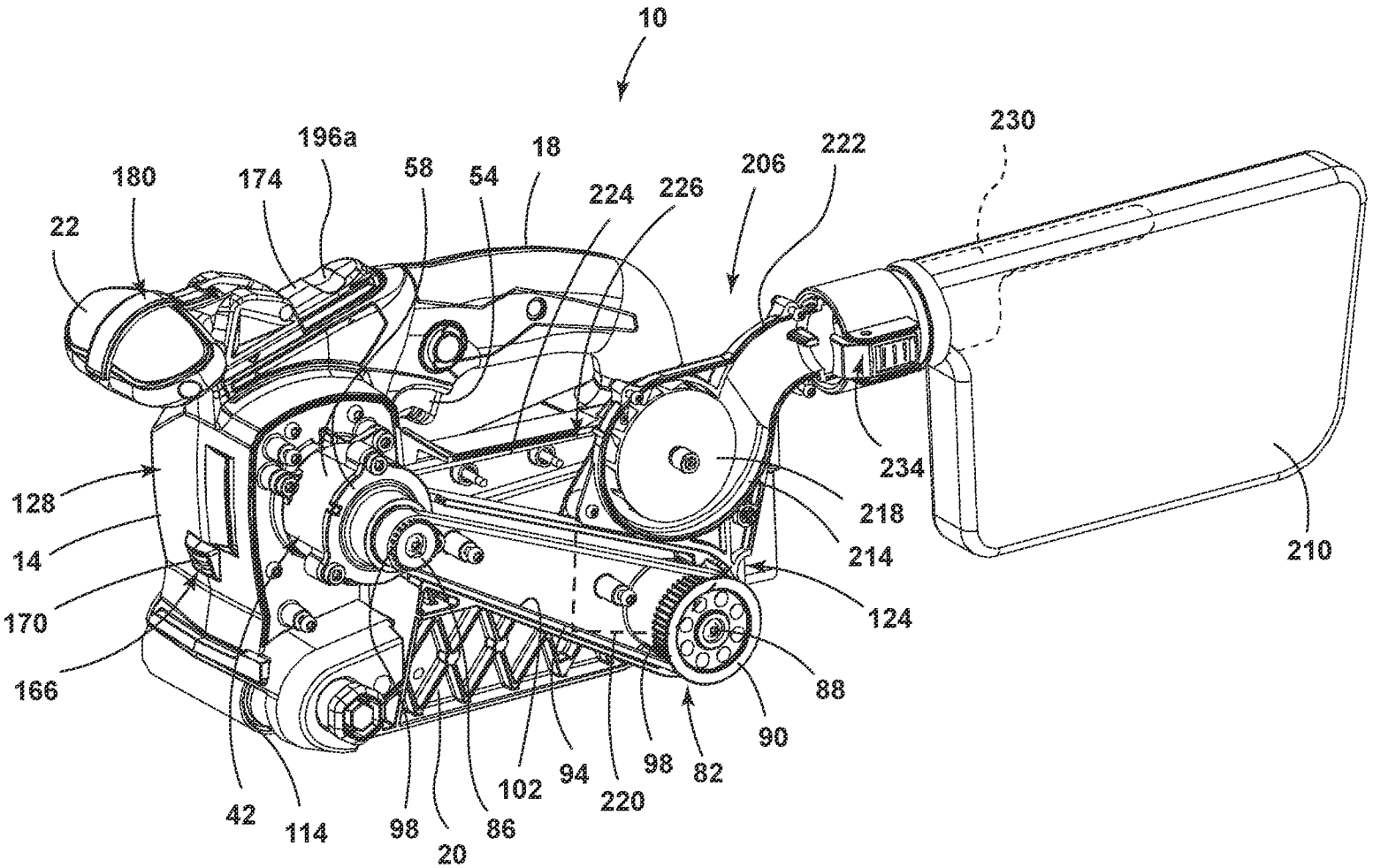
FIG. 3 is another perspective view of the belt sander, illustrating a portion of the drive unit of FIG. 2.

With reference to FIGS. 2 and 3, the drive unit 26 further includes a first pulley system 82 that is driven by the output shaft 74 of the transmission 42. The first pulley system 82 is downstream of the transmission 42, such that the transmission 42 is positioned between the motor 34 and the first pulley system 82 in a direction along the motor axis 46. As a result, the output shaft 74 (and therefore, the first pulley system 82) has a reduced angular velocity compared to the drive shaft 38 due to the gear reduction of the transmission 42. The first pulley system 82 includes a first pulley 86 coupled for co-rotation with the output shaft 74 and a second pulley 90 driven by the first pulley 86 via a pulley belt 94 (FIG. 3) about a driven shaft 88. Both the first pulley 86 and the second pulley 90 are supported by the main frame 20. On the outer periphery of the first and second pulley 86, 90 are teeth 98 that intermesh with corresponding teeth 102 of the pulley belt 94 to provide a positive engagement therebetween and a synchronous drive between the belt 94 and the pulleys 86, 90. The second pulley 90 is coupled to a drive belt system 106 (FIG. 4) that drives the sanding belt 30, as described in further detail below.

Figure 15A:
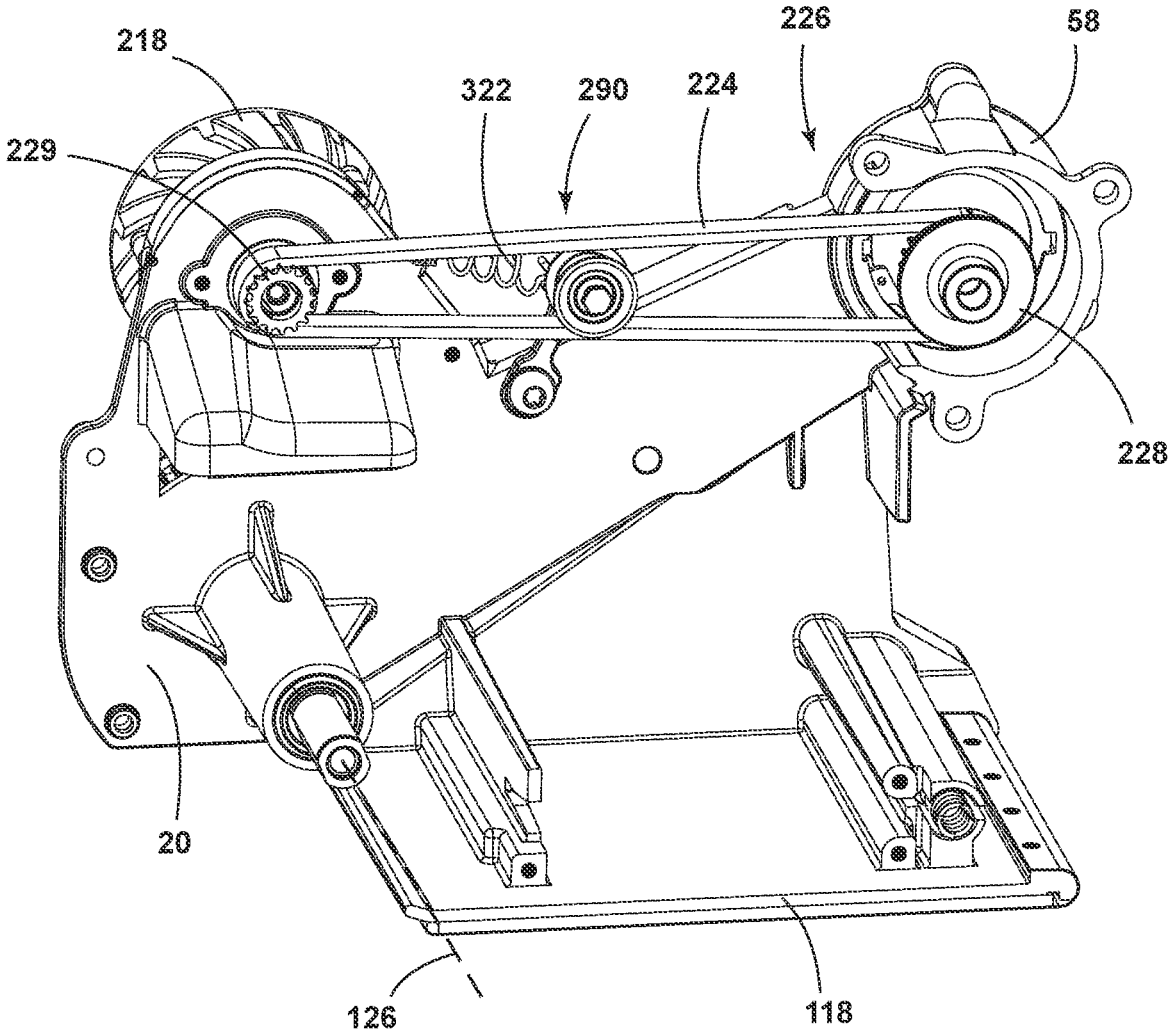
FIG. 15A is another perspective view of the belt sander, illustrating a second pulley system for driving the dust extraction unit.
Figure 17:
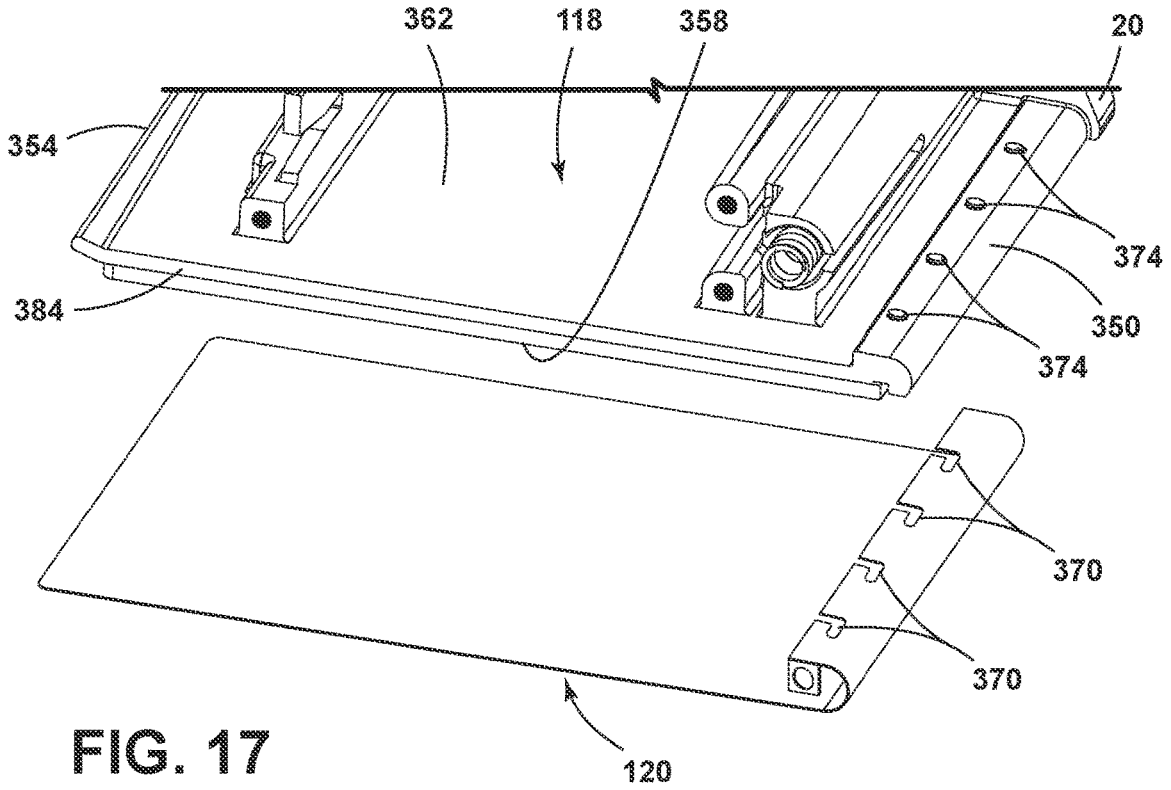
FIG. 17 is an exploded perspective view of the platen and a platen attachment configured to be coupled to the platen.
Figure 18:
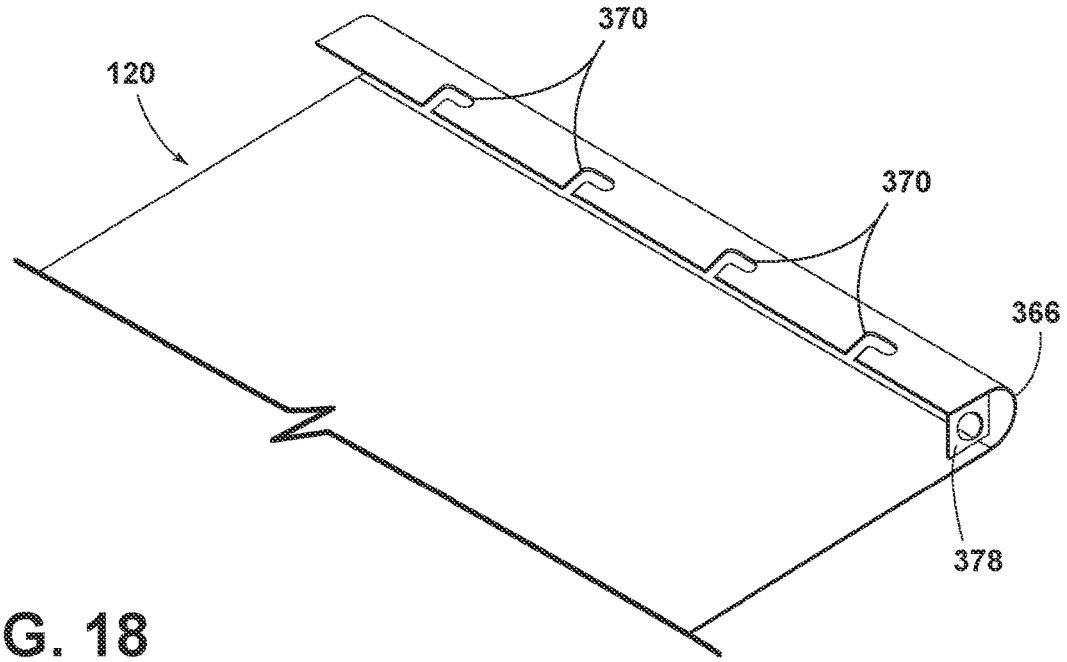
FIG. 18 is an enlarged perspective view of the platen attachment of FIG. 17, illustrating a plurality of slots disposed on a first lip of the platen attachment.

With reference to FIGS. 2-4, the drive belt system 106 includes a drive wheel 110, a driven wheel 114 driven by the drive wheel 110 via the sanding belt 30, and a platen 118 disposed between the drive wheel 110 and the driven wheel 114. In some embodiments, the platen 118 is integrally formed with the main frame 20 (FIG. 15A). When the sanding belt 30 is being driven by the drive wheel 110, the sanding belt 30 slides along the platen 118 (or a platen attachment 120 coupled to the platen 118, as shown in FIG. 17), creating a flat, working surface 122 that presses the sanding belt 30 against a workpiece. The drive wheel 110 is disposed adjacent a rear end 124 of the belt sander 10 and defines a drive wheel axis 126, whereas the driven wheel 114 is disposed adjacent a front end 128 of the belt sander 10 and defines a driven wheel axis 130. As illustrated in FIG. 2, the motor axis 46, the drive wheel axis 126, and the driven wheel axis 130 are all parallel. A tensioning mechanism 134 is coupled to the driven wheel 114 and is capable of moving the driven wheel 114 between a retracted position, in which the sanding belt 30 may be removed from the sander 10, and an extended position, in which the sanding belt 30 is placed under tension and inhibited from being removed from the sander 10. Specifically, the driven wheel 114 moves toward the drive wheel 110 in the retracted position to allow the sanding belt 30—having a fixed, rigid circumference—to fit around the drive wheel 110 the driven wheel 114, and the platen 118.

Returning to FIG. 2, the components of the belt sander 10 are situated in a specific arrangement to improve the center of gravity, ergonomics, longevity, and performance of the belt sander 10, as described in further detail below. The main housing 14 incudes a first lateral sidewall 138 (as represented by broken line in FIG. 2) and a second lateral sidewall 142 opposite the first lateral sidewall 138. The belt sander 10 defines a center of gravity that is located between first and second lateral sidewalls 138, 142. Specifically, the center of gravity for the belt sander 10 is located within a first upright plane 146 that is approximately equal distance from the first and second lateral sidewalls 138, 142. By positioning the transmission 42 between the motor 34 and the first pulley system 82, the plane 146 (which contains the center of gravity) is situated centrally within the belt sander 10 because the weight of the motor 34 is positioned proximate the first lateral sidewall 138, thereby counteracting the weight of the first pulley system 82 positioned proximate the second lateral sidewall 142 without increasing the length of the drive shaft 38. That is, the transmission 42 enables the motor 34 and the first pulley system 82 to be positioned further apart (i.e., near opposite lateral sidewalls 138, 142) without compromising the integrity of the drive shaft 38. As a result, the transmission 42 avoids unnecessary length extensions of the drive shaft 38, which can inadvertently cause excessive shaft vibration, reduced tool balance, excessive torsional deflection, reduced shaft longevity, and reduced longevity of connected components (e.g., the motor 34, the first pulley system 82, etc.).

With continued reference to FIG. 2, the primary handle 18 defines a second upright plane 150 that extends through the center of the primary handle 18, while the platen 118 defines a third upright plane 154 that extends through the center of the platen 118 in a direction perpendicular to the platen 118. Each plane 146, 150, 154 is parallel and substantially perpendicular relative to a support surface (e.g., the ground). As shown in FIG. 2, the first upright plane 146 is closer to the second upright plane 150 than the third upright plane 154. Also, the first lateral sidewall 138 is closer to the third upright plane 154 than the second upright plane 150. In this configuration, the motor 34 is intersected by both the second upright plane 150 and the third upright plane 154. By positioning the motor 34 in this manner, the motor 34 is adjacent the first lateral sidewall 138 while the first pulley system 82 is adjacent the second lateral sidewall 142, thereby providing sufficient volume within the main housing 14 to accommodate the transmission 42. This configuration of components (e.g., the motor 34, the transmission 42, and the first pulley system 82) also moves the first upright plane 146, and therefore the center of gravity, towards the third upright plane 154, which optimizes weight distribution on the working surface 122. As a result, the reliability of the belt sander 10 is increased, and the vibration and noise emitted by the drive unit 26 is also decreased. Further, the ergonomics of the belt sander 10 is improved due to the optimized center of gravity.

With reference to FIGS. 1 and 5, the belt sander 10 further includes a first light 158 with a first lens 162 disposed on the first lateral sidewall 138 and a second light 166 with a second lens 170 disposed on the front end 128. The lights 158, 166 provide a user increased visibility during operation, especially in instances where light may be limited (e.g., dark corners of a workpiece). In the illustrated embodiment, the lights 158, 166 are light-emitting diodes (LEDs), but may alternatively be different types of lights in other embodiments.

Referring to FIG. 5, the first lens 162 is a convex lens, such that light emitted from the LED diverges outward from the first lateral sidewall 138 and projects downward onto area A1 of a workpiece that runs alongside the first lateral sidewall 138. Similarly, the second lens 170 is a convex lens, such that light emitted from the LED diverges outward from the front end 128 and projects downward onto area A2 of a workpiece that is adjacent the driven wheel 114. The second lens 170 also projects light outward in front of the belt sander 10 onto area A3 of a workpiece to reveal deformities and finish quality on a workpiece. Specifically, the second light 166 is positioned in the lower half of the main housing 14 on the front end 128, such that the incident ray (i.e., light rays coming from the second light 166) has an acute angle of incidence relative to a workpiece, creating shadows on a workpiece where deformities may exist in front of the front end 128. Generally, the absence of shadows on a workpiece indicates absence of deformities (e.g., bumps, divots, scratches, etc.). Lastly, the first and second lights 158, 166 assist a user from inadvertently running into and damaging (e.g., marring) walls of a workpiece due to lack of light.

Figure 6:
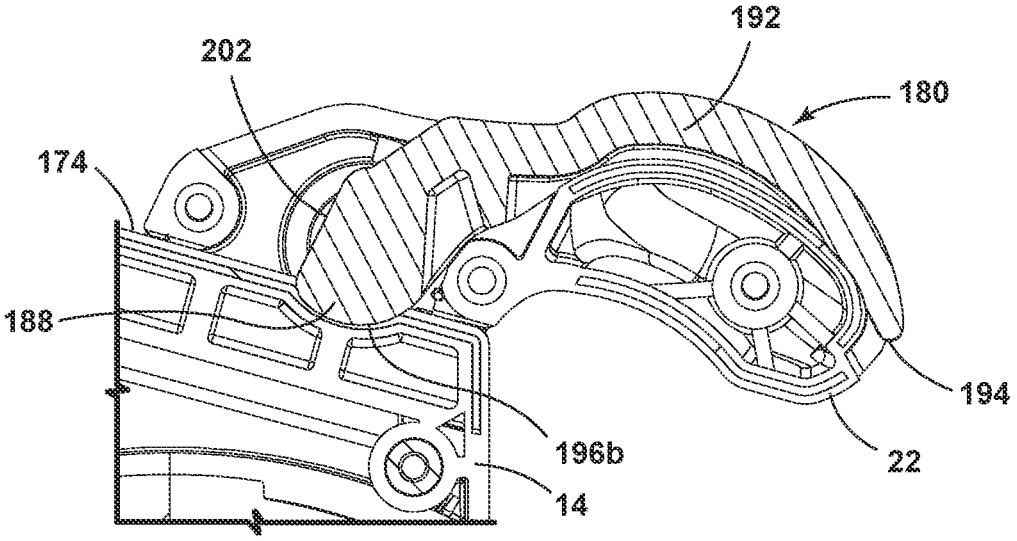
FIG. 6 is a cross-sectional view of a pommel, taken along line 6-6 of FIG. 5.
Figure 7:
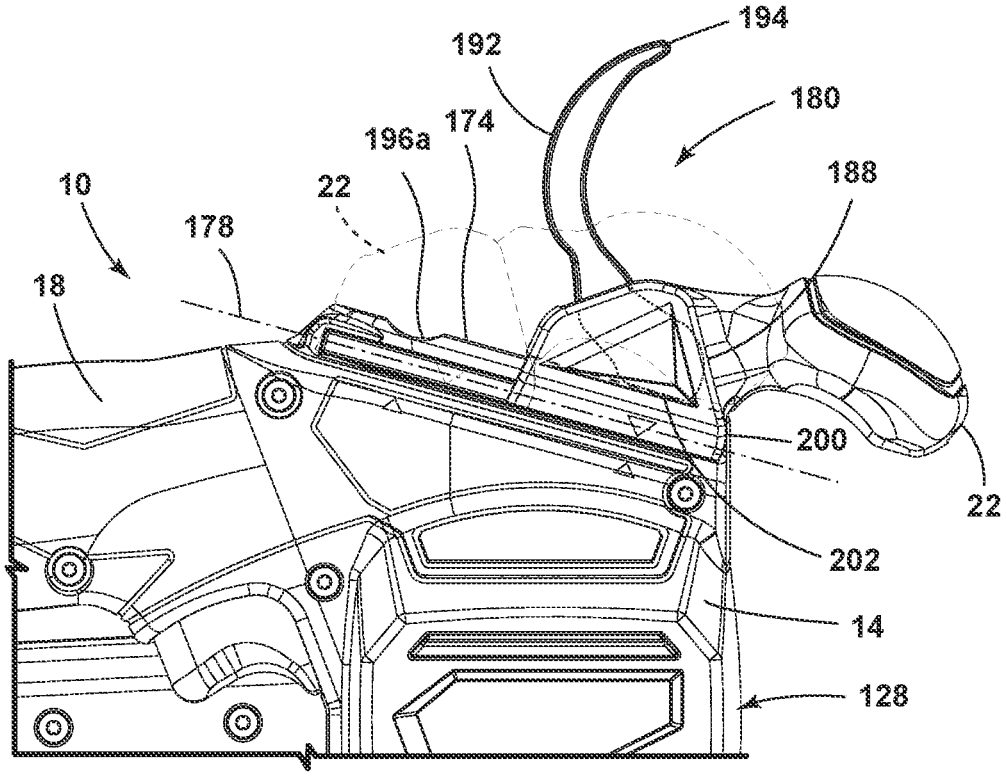
FIG. 7 is a side plan view of the belt sander of FIG. 1, illustrating the pommel in an unlocked position and slidable along a rail of the main housing.
Figure 8:
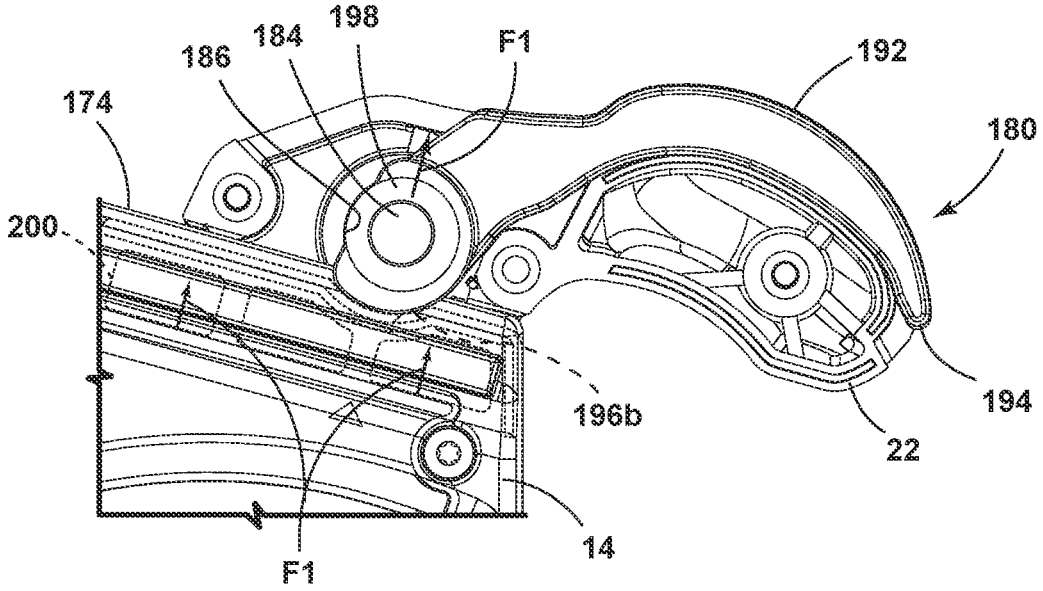
FIG. 8 is a cross-sectional view of the pommel in a locked position, taken along line 8-8 of FIG. 5.

With reference to FIGS. 6-8, the secondary handle 22 of the belt sander 10 is moveable relative to the main housing 14. Specifically, the main housing 14 includes a rail 174, upon which the secondary handle 22 is moveably mounted along a rail axis 178 (FIG. 7). The secondary handle 22 includes a lock system 180 that is pivotable between a locked state, in which the secondary handle 22 is inhibited from moving along the rail 174, and an unlocked state, in which the secondary handle 22 is permitted to move along the rail 174.

With continued reference to FIGS. 6-8, the lock system 180 includes an axle 184 (FIG. 8) received within corresponding counterbores 186 in the secondary handle 22, a cam body 188 disposed around the axle 184 (FIG. 6), and a lever 192 extending away from the cam body 188 and capable of rotating the cam body 188. In the locked state, the lever 192 is substantially flush (i.e., flush, slightly sub-flush, or slightly proud, etc.) with the geometry of the secondary handle 22, such that a user does not feel the lever 192 when it is in the locked state. However, at a distal end of the lever 192 is a lip 194 that extends beyond the secondary handle 22 to allow a user to grasp the lever 192 when the lock system 180 is in the locked state. Furthermore, the cam body 188 (FIG. 6) is received within one of two arcuate recesses 196*a*, 196*b* on the rail 174 when the lock system 180 is in the locked state. As such, the secondary handle 22 is moveable along the rail 174 between two discrete positions—a rearward position (as represented by phantom lines in FIG. 7) and a forward position (as represented by solid lines in FIG. 7). In the rearward position, the cam body 188 is received within the arcuate recess 196*a*. In the forward position, the cam body 188 is received within arcuate recess 196*b*.

Not only does the cam body 188 mechanically interfere with the rail 174 to inhibit movement of the secondary handle 22 relative to the rail 174, but the cam body 188 also mechanically interferes with the arcuate recesses 196*a*, 196*b* when received therein. The mechanical interference between the cam body 188 and the arcuate recesses 196*a*, 196*b* causes the lock system 180 to displace upward relative to the rail 174 against the bias of a spring 198 (FIG. 8). As a result of the lock system 180 displacing upwardly, the spring 198 deforms and a force component F1 is exerted on a track 200 of the secondary handle 22, causing the secondary handle 22 to displace in a direction substantially perpendicular to the rail axis 178. Subsequently, the slop (i.e., play) or relative movement between the track 200 of the secondary handle 22 and the rail 174 is limited when the lock system 180 is in the locked state. At this point, there is increased surface area contact between the track 200 and the rail 174, which increases friction and inhibits the secondary handle 22 from moving. In the illustrated embodiment, the spring 198 is an O-ring disposed between the axle 184 and each counterbore 186 of the secondary handle 22. The spring 198 (or O-ring) is composed of an elastomeric material, allowing for relative movement between the axle 184 and the counterbore 186 of the secondary handle 22. In other embodiments, the spring 198 may alternatively be a compression spring, an extension spring, or other elastic material capable of elastic deformation.

With reference to FIG. 7, the lock system 180 further includes a plateau 202, which is a flat region disposed on the cam body 188 that creates a discontinuity on the cam body 188. The plateau 202 removes the cam body 188 from the rail 174 when the lock system 180 is in the unlocked state. Specifically, the plateau 202 is disposed on the cam body 188, such that the cam body 188 is spaced away from the rail 174 when the lock system 180 is in the unlocked state. In other words, the cam body 188 is removed from one of the arcuate recesses 196*a*, 196*b* and the plateau 202 is substantially parallel to the rail axis 178 when the lock system 180 is actuated to the unlocked state. At this point, the track 200 of the secondary handle 22 is capable of sliding along the rail 174 between the rearward position and the forward position. Once the secondary handle 22 is moved to either the rearward position or the forward position, the plateau 202 is aligned with the respective arcuate recess 196*a*, 196*b*, at which point the lock system 180 may be actuated to the locked state where the cam body 188 rotates into the respective arcuate recess 196*a*, 196*b*. In the unlocked state, the lever 192 experiences rotational resistance due to frictional forces as the axle 184 slides within the spring 198 (i.e., O-ring).

With reference to FIG. 3, the belt sander 10 further includes a dust extraction unit 206 coupled to and extending from the main housing 14. The dust extraction unit 206 draws dust particles and other debris away from a workpiece and collects the debris in a dust bag 210 during operation. The dust extraction unit 206 includes a shroud 214 and a fan 218 disposed within the shroud 214. The shroud 214 includes an inlet 220 that is adjacent the platen 118 and an outlet 222 that is adjacent the dust bag 210. The fan 218 is driven by the motor 34 via a pulley belt 224 of a second pulley system 226 (including a first pulley 228 and second pulley 229; FIG. 15A), such that the fan 218 is configured to create a low-pressure region near the platen 118 to draw debris into the inlet 220. As shown in FIGS. 2 and 3, the second pulley system 226 is coupled to the drive shaft 38 upstream of the transmission 42 via the first pulley 228. That said, the transmission 42 is disposed between the first pulley system 82 and the second pulley system 226. As a result, the first pulley system 82 and the second pulley system 226 are coaxially driven along the motor axis 46, albeit at different speeds. Specifically, the first pulley system 82 is driven at a first speed that is identical to the angular velocity of the output shaft 74, whereas the second pulley system 226 is driven at a second speed that is identical to the angular velocity of the drive shaft 38. The angular velocity of the second speed is greater than the angular velocity of the first speed due to the gear reduction of the transmission 42. Although the first and second pulley systems 82, 226 are being coaxially driven along the motor axis 46, in other embodiments, the first and second pulley systems 82, 226 may alternatively be driven along parallel axes.

Figure 14:
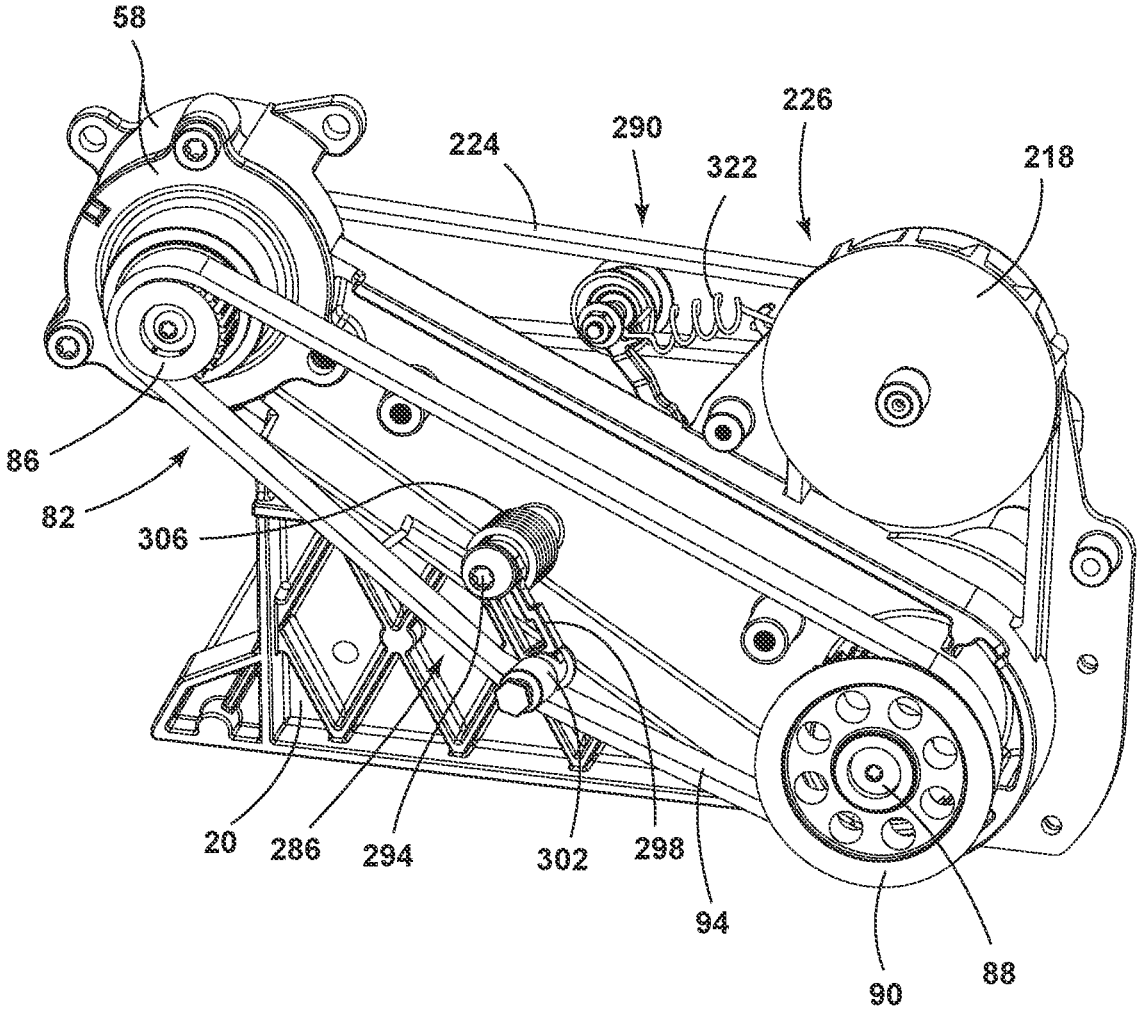
FIG. 14 is a perspective view of the belt sander, illustrating a first pulley system for driving the belt drive system.

With reference to FIGS. 14 and 15, the first pulley system 82 further includes a first belt tensioner 286 and the second pulley system 226 includes a second belt tensioner 290. The first belt tensioner 286 is mounted to the main frame 20 and disposed within the inner periphery of the pulley belt 94 of the first pulley system 82. The first belt tensioner 286 includes an axle 294 coupled to the main frame 20, an arm 298 coupled to and extending perpendicularly relative to the axle 294, and a first roller 302 rotatably coupled to the arm 298. The first roller 302 extends away from the arm 298 into the path of the pulley belt 94, such that the first roller 302 is in contact with the pulley belt 94. A spring 306 (e.g., a torsion spring, etc.) is disposed around the axle 294 and biases the arm 298 in a clockwise direction (frame of reference from FIG. 14) to bias the first roller 302 into contact with the inner periphery of the pulley belt 94.

With reference to FIG. 15A, the second belt tensioner 290 is also mounted to the main frame 20 and disposed within the inner periphery of the pulley belt 224 of the second pulley system 226. The second belt tensioner 290 includes an axle 310 coupled to the main frame 20, an arm 314 coupled to and extending perpendicularly relative to the axle 310, and a second roller 318 rotatably coupled to the arm 314. The second roller 318 extends away from the arm 314 into the path of the pulley belt 224, such that the second roller 318 is in contact with the pulley belt 224. A spring 322 (e.g., a tension spring, etc.) is coupled between the main frame 20 and the arm 314, and biases the arm 314 in a counterclockwise direction (frame of reference from FIG. 15A) to bias the second roller 318 into contact with the inner periphery of the pulley belt 224. The first belt tensioner 286 and the second belt tensioner 290 apply tension to the respective pulley belts 94, 224, thereby reducing belt tension variation and prolonging the longevity of the pulley belts 94, 224.

Figure 16:
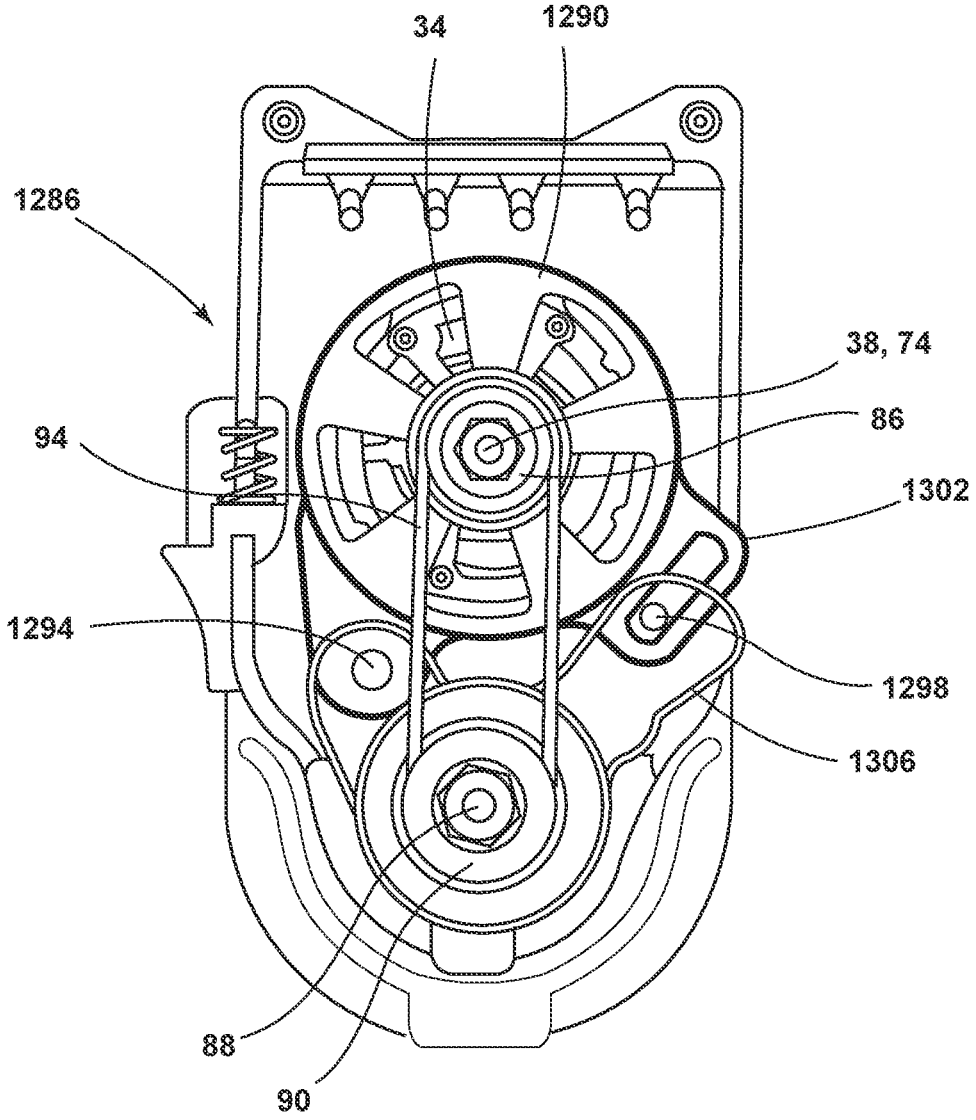
FIG. 16 is a plan view of the belt sander, illustrating the first pulley system for driving the belt drive system in accordance with another embodiment.

In other embodiments, the belt sander 10 may alternatively include a belt tensioner 1286 that is configured to adjust the tension of at least one of the pulley belts 94, 224. The belt tensioner 1286 includes the drive shaft 38, the output shaft 74, the first pulley 86, the driven shaft 88, and the second pulley 90. In some embodiments, the belt tensioner 1286 may also include at least one of the motor 34 and the transmission housing 58. With reference to FIG. 16, the motor 34 drives the drive shaft 38 which, in turn, drives the output shaft 74 and the first pulley 86. The first pulley 86 is coupled to and drives, for example, the pulley belt 94 and the second pulley 90 via the pulley belt 94. The motor 34 is disposed within a motor housing 1290, which is pivotably coupled within the main housing 14 about a pin 1294 such that the motor axis 46 is movable relative to the axis of the driven shaft 88. Specifically, the motor axis 46 is capable of being moved towards or away from the axis of the driven shaft 88 along an arcuate path in response to the motor housing 1290 pivoting about the pin 1294. If the motor axis 46 is moved towards the axis of the driven shaft 88, then slack is introduced into the pulley belt 94. If, on the other hand, the motor axis 46 is moved away from the axis of the driven shaft 88, then slack is removed and the pulley belt 94 is tensioned. When the motor housing 1290 is pivoted about the pin 1294 to the desired location, the motor housing 1290 is fixed into position via a fastener 1298. In the illustrated embodiment, the motor housing 1290 includes a motor bracket 1302 extending away from the motor housing 1290 that receives the fastener 1298. In some embodiments, the motor housing 1290 is fixed into position by rigidly interconnecting the motor housing 1290 and a bracket 1306 of the second pulley 90 via the fastener 1298. Although not illustrated, the belt tensioner 1286 may also be employed for tensioning the pulley belt 224. Also not illustrated, the belt tensioner 1286 may include a handle or actuator disposed outside the main housing 14 so that a user can manipulate the handle or actuator to adjust the distance between the first pulley 86 and the second pulley 90.

Figure 15B:
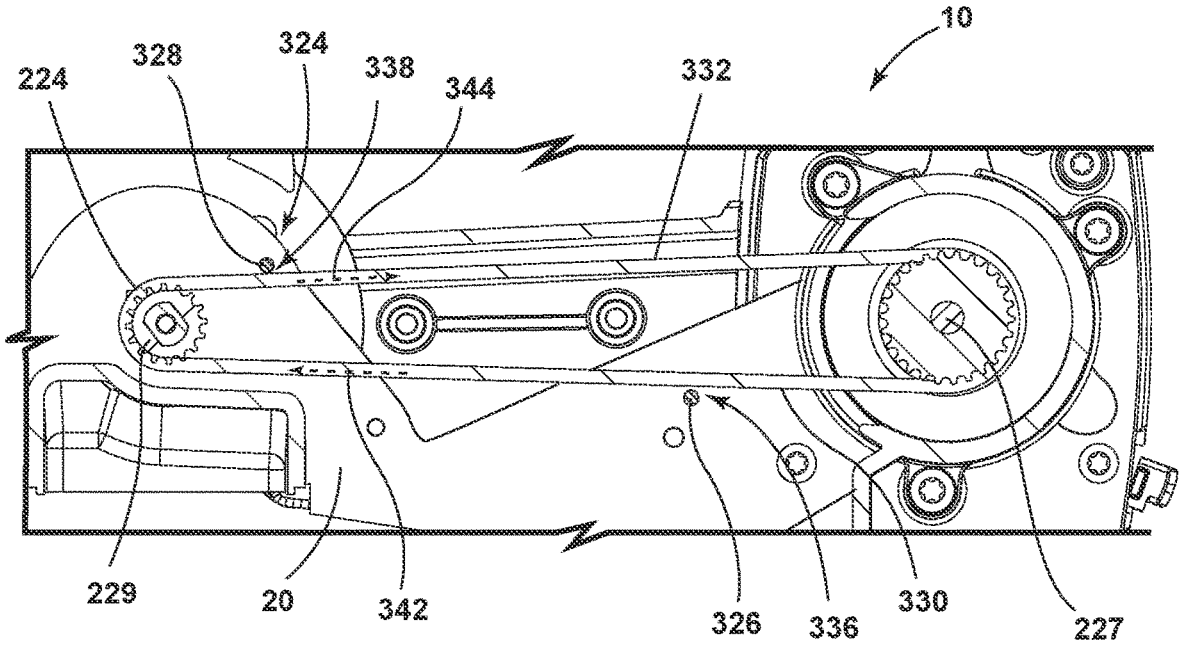
FIG. 15B is a plan view illustrating a vibration dampening system for the second pulley.

As illustrated in FIG. 15B, the belt sander 10 may also include a vibration dampening system 324. In some embodiments, the vibration dampening system 324 may be in addition to the belt tensioner 286, 290, or replace the belt tensioner 286, 290 altogether. The vibration dampening system 324 includes a plurality of wave disruptors 326, 328 disposed adjacent the pulley belt 224 and coupled to the main frame 20. The wave disruptors 326, 328 are configured to cancel or disrupt any waves in the pulley belt 224 that form as a result of vibration in the belt sander 10. In the illustrated embodiment of FIG. 15B, the first wave disruptor 326 is positioned adjacent the first pulley 228, whereas the second wave disruptor 328 is positioned adjacent the second pulley 229. Furthermore, the first wave disruptor 326 is disposed adjacent a lower run 330 of the pulley belt 224, whereas the second wave disruptor 328 is disposed adjacent an upper run 332 of the pulley belt 224. Additionally, each wave disruptor 326, 328 is positioned away from the outer periphery of the pulley belt 224 to avoid contact with the pulley belt 224. Specifically, the first and second wave disruptors 326, 328 are positioned a small distance away from the lower run 330 and the upper run 332, respectively, thereby defining a first air gap 336 between the first wave disruptor 326 and the lower run 330, and defining a second air gap 338 between the second wave disruptor 328 and the upper run 332. In other words, the first and second wave disruptors 326, 328 are not in immediate contact with the pulley belt 224 when the lower and upper runs 330, 332 are traveling along their respective straight-line paths 342, 344. The air gaps 336, 338 are intended to avoid excessive rubbing and heat generation between the pulley belt 224 and the wave disruptors 326, 328, resulting in increased lifespan of the pulley belt 224. Although the vibration dampening system 324 of the illustrated embodiment is disposed adjacent the pulley belt 224, in other embodiments, the vibration dampening system 324 may also be incorporated adjacent the pulley belt 94.

The wave disruptor 326 is only capable of engaging the lower run 330 at a single contact point. Likewise, the wave disruptor 328 is only capable of contacting the upper run 332 at a single contact point.

During operation, the lower run 330 and the upper run 332 travel along the respective straight-line paths 342, 344 between the first pulley 228 and the second pulley 229. Specifically, the lower run 330 travels from the first pulley 228 to the second pulley 229 along the straight-line path 342, while the upper run 332 travels from the second pulley 229 to the first pulley 228 along the straight-line path 344. In some instances, however, the pulley belt 224 may begin to oscillate or vibrate, such that the lower run 330 and the upper run 332 no longer travel along the straight-line paths 342, 344. Rather, the lower run 330 and the upper run 332 may begin to form waves (e.g., sinusoidal wave forms) between the first and second pulley 228, 229. These oscillations or waves of the pulley belt 224 can cause unwanted damage and wear to the pulley belt 224 and may reduce the lifespan of the pulley belt 224. When a single oscillation (e.g., wave) of the lower run 330 reaches an amplitude (i.e., perpendicular height from the straight-line path 342 to the crest of the wave) equivalent to the first air gap 336, the first wave disruptor 326 is capable of contacting the lower run 330, thereby interrupting the wave so the lower run 330 can travel along the straight-line path 342 again. Additionally, when the oscillation (e.g., wave) of the upper run 332 reaches an amplitude (i.e., perpendicular height from straight-line path 344 to the crest of the wave) equivalent to the second air gap 338, the second wave disruptor 328 contacts the upper run 332, thereby interrupting the wave so the upper run 332 can travel along the straight-line path 344 again. Therefore, the vibration dampening system 324 is engageable with the pulley belt 224 to inhibit oscillations within the pulley belt 224 and maintain the pulley belt 224 traveling along the straight-line paths 342, 344 to increase the lifespan of the pulley belt 224.

Figure 15C:
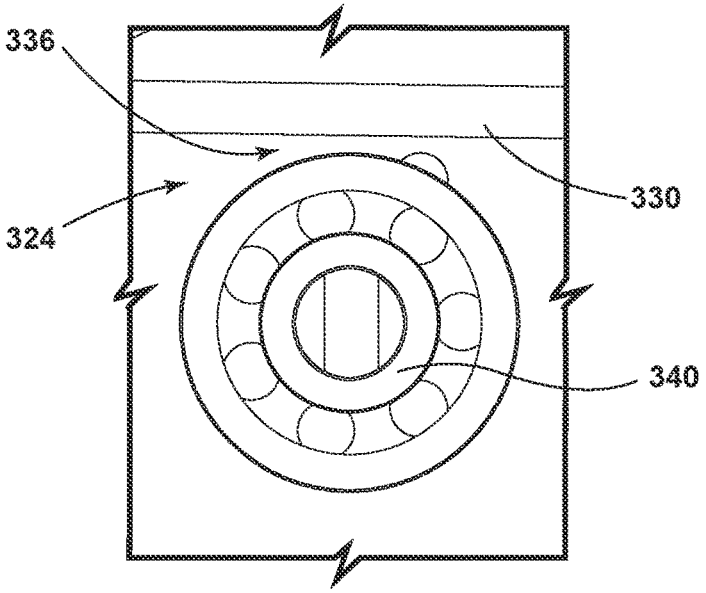
FIG. 15C is an enlarged plan view of a vibration dampening system in accordance with another embodiment, illustrating a bearing for the dampening system.

In the illustrated embodiment of FIG. 15B, the first and second wave disruptors 326, 328 are first and second pins, respectively. Each pin is merely a cylindrical pin that is press-fit into the frame 20, such that the pin is a stationary component that does not rotate. The pins may alternatively be another type of mechanical component. For example, FIG. 15C illustrates that the wave disruptors 326, 328 are first and second bearings 340, respectively. Each bearing 340 is disposed on a shaft, allowing the bearing 340 to rotate when the pulley belt 224 contacts the bearing 340. The bearing 340 can reduce friction, and therefore, increase the lifespan of the pulley belt 224. Still, in further embodiments, the wave disruptors 326, 328 may alternatively be bushings, ceramic rollers, or other similar type of mechanical component.

Figure 9:
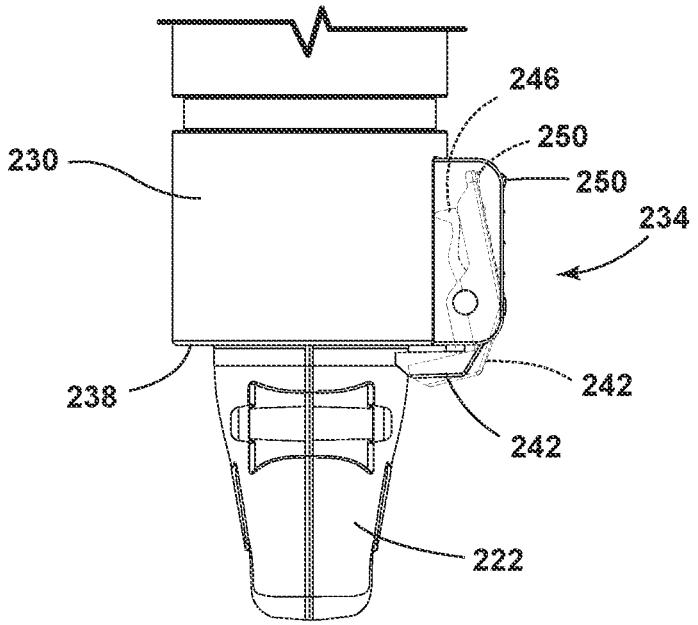
FIG. 9 is a plan view of a dust bag attachment mechanism for coupling a dust bag to the belt sander of FIG. 1.

With reference to FIG. 9, the dust bag 210 is removably coupled to the outlet 222 of the shroud 214. Specifically, the dust bag 210 includes a conduit inlet 230 and a quick-disconnect mechanism 234 that connects with the outlet 222 to secure the dust bag 210 onto the belt sander 10. The conduit inlet 230 fits over the outlet 222 (e.g., press fit, slip fit, etc.) while the quick-disconnect mechanism 234 is abutted with a shoulder 238 of the outlet 222. The shoulder 238 is annularly disposed around and extends away from the outlet 222, allowing the latch 242 to overlap with the shoulder 238 regardless of the orientation of the dust bag 210.

The quick-disconnect mechanism 234 includes a latch 242 that is biased towards the shoulder 238 via a compression spring 246. In other embodiments, the spring 246 is a torsional spring, a tension spring, or another type of spring. When the latch 242 overlaps the shoulder 238, the dust bag 210 is inhibited from inadvertent removal from the belt sander 10. A user, however, can pivot the latch 242 away from the shoulder 238 (as represented by broken lines of FIG. 9) by depressing a button 250 against the bias of the spring 246, causing the latch 242 to be spaced away from the shoulder 238 and permitting removal of the dust bag 210 from the outlet 222. In other embodiments, the latch 242 is an elastic body (e.g., a snap latch) that is capable of elastic deformation as the latch 242 slides over the shoulder 238 to permit attaching and removing the dust bag 210 to the belt sander 10. Once the dust bag 210 is removed from the belt sander 10, a user may empty the contents of the dust bag 210 into a waste receptacle, as described in further detail below.

Figure 10:
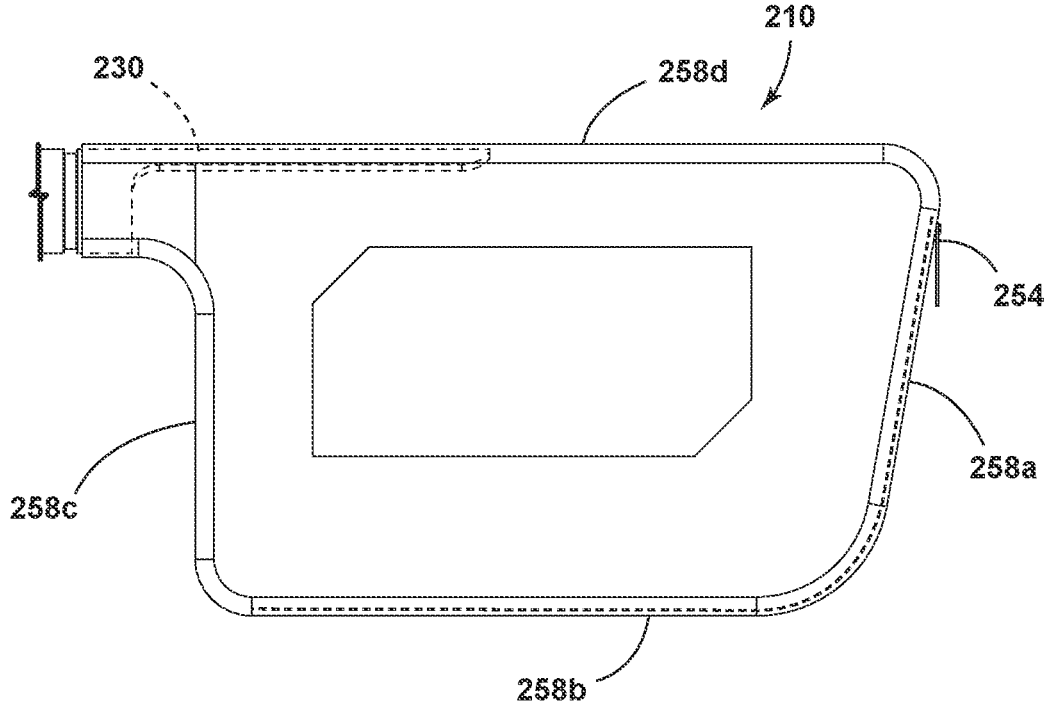
FIG. 10 is a plan view of the dust bag for the belt sander, illustrating a zipper extending along edges of the dust bag.

With reference to FIG. 10, the dust bag 210 further includes a zipper 254 for allowing access into the dust bag 210 and removal of dust and debris. The dust bag 210 is approximately rectangular in shape with the zipper 254 extending along the full length of two perpendicular edges 258*a*, 258*b* of the dust bag 210. The other two edges 258*c*, 258*d* are sewn closed with the conduit inlet 230 extending along and supporting the edge 258*d*. The conduit inlet 230 also provides structure to the dust bag 210 so the dust bag 210 does not collapse and clog airflow during operation. With the zipper 254 extending along the full length of the edges 258*a*, 258*b*, dust and debris within the dust bag 210 can be quickly emptied and disposed in a waste receptacle, leaving behind minimal debris in the corners of the dust bag 210 without heavy shaking of the dust bag 210. Although the zipper 254 of the illustrated embodiment is a single zipper that extends along edges both 258*a*, 258*b*, in other embodiments, multiple zippers may alternatively be used that each extend along the respective edges.

Figure 11:
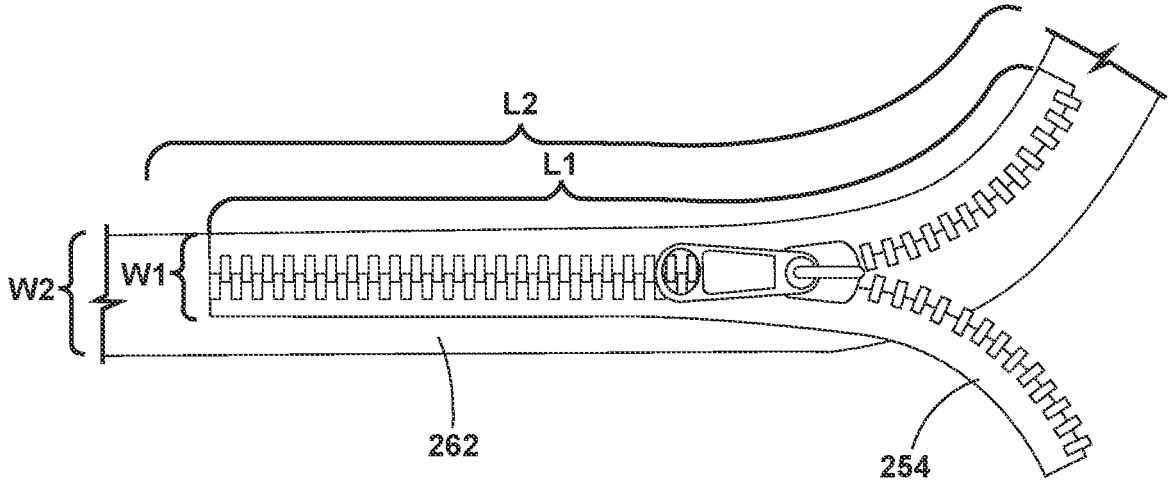
FIG. 11 is a schematic of the zipper of the dust bag, illustrating a flap disposed behind the zipper on the interior of the dust bag.

With reference to FIG. 11, the dust bag 210 further includes a flap 262 of extra fabric disposed along the zipper 254. Specifically, the flap 262 is disposed on the inside of the dust bag 210 and shields the zipper 254 from dust particles and debris that can otherwise escape through the teeth of the zipper 254, causing the zipper 254 to clog and jam. As such, the flap 262 extends at least along the entire length L1 of the zipper 254, as well as extends at least the entire width W1 of the zipper 254. In fact, a length L2 of the flap 262 is longer than the length L1 of the zipper and a width W2 of the flap 262 is wider than the width W1 of the zipper 254.

Thus, for debris to escape through the zipper 254, the debris must first navigate around the flap 262 and through the teeth of the zipper 254. The flap 262 inhibits dust particles from escaping the dust bag 210 and reduces the likelihood that the zipper 254 will clog from a buildup of dust particles between the teeth of the zipper 254.

With reference to FIGS. 12A-13, the belt sander 10 further includes a wiring bridge 266 that conducts electrical current across a joint 268 (FIG. 13) between the clamshell halves 16*a*, 16*b*. To provide some background, the routing of wires in tools and other devices is often distributed throughout both clamshell halves. Oftentimes, some wire routing is required to span across the separate clamshell halves 16*a*, 16*b* in order to electrically connect all components within the tool or device. So, a wire is used to span across the joint between the two clamshell halves, resulting in blind wire routing during assembly and possible inadvertent damage to the wire or other components.

With continued reference to FIGS. 12A-13, the clamshell half 16*a* includes an electrical processor 270 with a first set of wires 274*a*, 274*b* extending therefrom to transport electrical current and signals to/from various components of the belt sander 10 (e.g., motor 34, battery pack 50, trigger 54, first light 158, etc.). The other clamshell half 16*b* includes a second set of wires 278*a*, 278*b* that are capable of electrically communicating with the first set of wires 274*a*, 274*b* (FIG. 13) and other components coupled to the clamshell half 16*b* (e.g., second light 166, etc.). The wiring bridge 266 includes a first compression spring 282*a* and a second compression spring 282*b* that each extend beyond the clamshell half 16*a* and capable of spanning across the joint 268 between the clamshell halves 16*a*, 16*b*. As shown in FIG. 12B, the first spring 282*a* is seated within the clamshell half 16*a* against the wire 274*a* (e.g., via a wire terminal, as shown) and the second spring 282*b* is seated within the clamshell half 16*a* against the wire 274*b* (e.g., via a wire terminal, as shown). In this embodiment, the springs 282*a*, 282*b* are parallel and have the same diameter and length, but in other embodiments, the springs 282*a*, 282*b* may alternatively be coaxial with different diameters and lengths.

With reference to FIG. 13, the wiring bridge 266 electrically connects wires 274*a* and 278*a* together and separately electrically connects wires 274*b* and 278*b* together. Specifically, compression spring 282*a* is compressed between and electrically connects wires 274*a* and 278*a*, while compression spring 282*b* is compressed between and electrically connects wires 274*b* and 278*b* as the clamshell halves 16*a*, 16*b* are coupled together. The compression springs 282*a*, 282*b* serve as electrical conductors between the first set of wires 274*a*, 274*b* and the second set of wires 278*a*, 278*b*, such that the wiring bridge 266 is composed of an electrically conductive material. When the clamshell halves 16*a*, 16*b* are coupled, the compression springs 282*a*, 282*b* are compressed against wires 274*a*, 274*b*, 278*a*, 278*b*, respectively, to ensure that contact is maintained, and electrical connection is not inadvertently interrupted. Although the wiring bridge 266 of the illustrated embodiment is comprised of a set of compression springs, in other embodiments, the wiring bridge 266 may alternatively be comprised of a set of leaf springs or other type of elastic, conductive bodies.

With reference to FIG. 17, the platen 118 includes a front edge 350 adjacent the driven wheel 114, a rear edge 354 adjacent the drive wheel 110, a bottom side 358 that is configured to be in a facing relationship to a workpiece, and a top side 362 that is disposed opposite the bottom side 358. The top side 362, in particular, is in a facing relationship to the motor 34. The platen attachment 120 is removably coupled to the platen 118 and extends between the front and rear edges 350, 354 on the bottom side 358 of the platen 118. In the illustrated embodiment, a nitride surface coating exists on the platen attachment 120 to decrease the coefficient of friction between the platen attachment 120 and the sanding belt 30. In some embodiments, the platen attachment 120 is composed of 1080 steel.

With reference to FIGS. 18-21, the platen attachment 120 includes a first lip 366 that is configured to bend around the front edge 350 of the platen 118. That is, the platen attachment 120 extends along the bottom side 358 of the platen 118 and curls around the front edge 350 to the top side 362 of the platen 118. The platen attachment 120 includes a plurality of slots 370 disposed along the first lip 366 that are configured to correspondingly receive a plurality of pins 374 disposed on the top side 362 of the platen 118. The plurality of slots 370 align with the plurality of pins 374, which are evenly spaced apart along the top side 362 of the platen 118 in a direction parallel to the driven wheel axis 130. The plurality of pins 374 are not accessible by a user unless the belt sander 10 is disassembled. The plurality of slots 370 are L-shaped such that one leg of the slots 370 extends along a direction perpendicular to the driven wheel axis 130 and another leg of the slots 370 extends along a direction parallel to the driven wheel axis 130. The L-shape of the slots 370 assists with assembly of the platen attachment 120, as described in further detail below. In the illustrated embodiment, there are four slots 370 and four pins 374, while in other embodiments, there may alternatively be more or fewer than four slots 370 and corresponding pins 374. Although the illustrated embodiment incorporates the plurality of pins 374, in other embodiment, the pins 374 may alternatively be fasteners, screws, or the like threaded into the platen 118.

With continued reference to FIGS. 18-21, the platen attachment 120 further includes a tab 378 disposed on the first lip 366. The tab 378 extends downward from the top side 362 toward the bottom side 358 of the platen 118. The tab 378 is configured to receive a fastener 382 (FIG. 21) that threads into a sidewall 384 of the platen 118 to further couple the platen attachment 120 to the platen 118, as described in further detail below.

Figure 22:
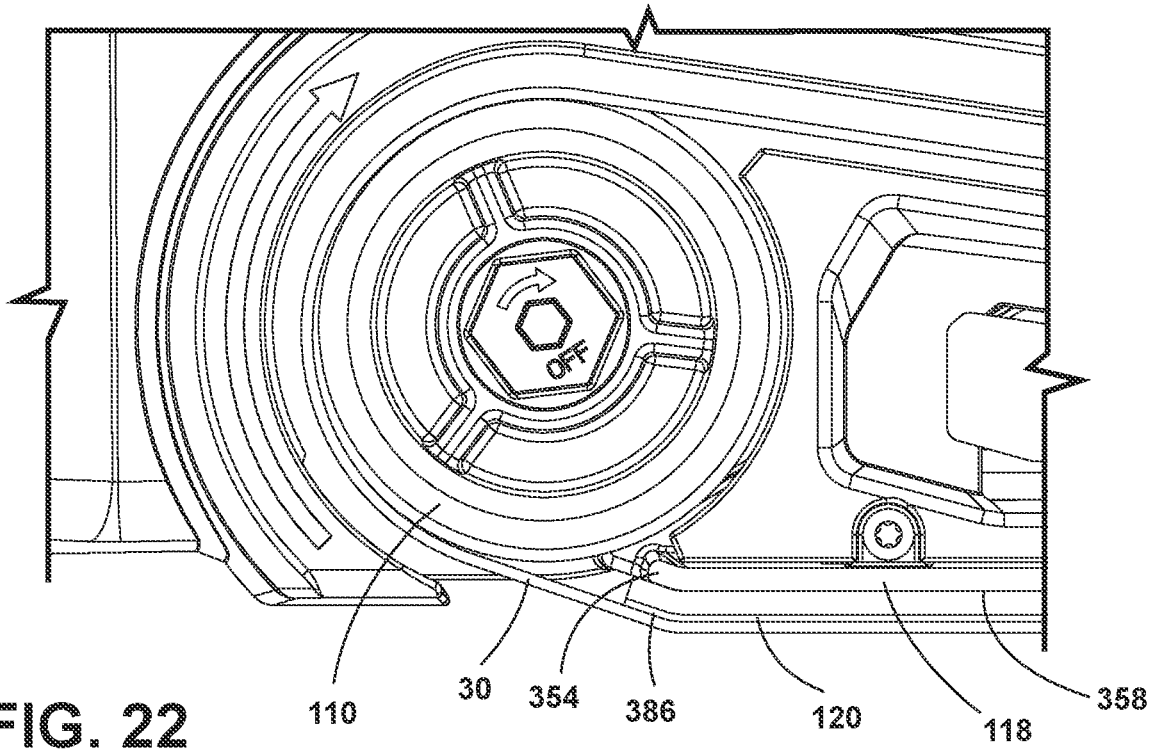
FIG. 22 is a side plan view of a platen attachment in accordance with another embodiment, illustrating the platen attachment coupled to the platen and including a second lip.

With reference to FIG. 22, the platen attachment 120 further includes a second lip 386 that is disposed adjacent the bottom side 358 and the rear edge 354 of the platen 118. In the illustrated embodiment, the second lip 386 bends along a corresponding bend of rear edge 354 of the platen 118. The second lip 386 bends along a large radius and extends along a path that is tangential to the radius of the drive wheel 110. As such, the sanding belt 30 and the second lip 386 extend along parallel paths when the sanding belt 30 no longer engages a workpiece. The second lip 386 decreases wear rates of the sanding belt 30 and decreases temperature generation between the platen attachment 120 and the sanding belt 30.

Figure 23:
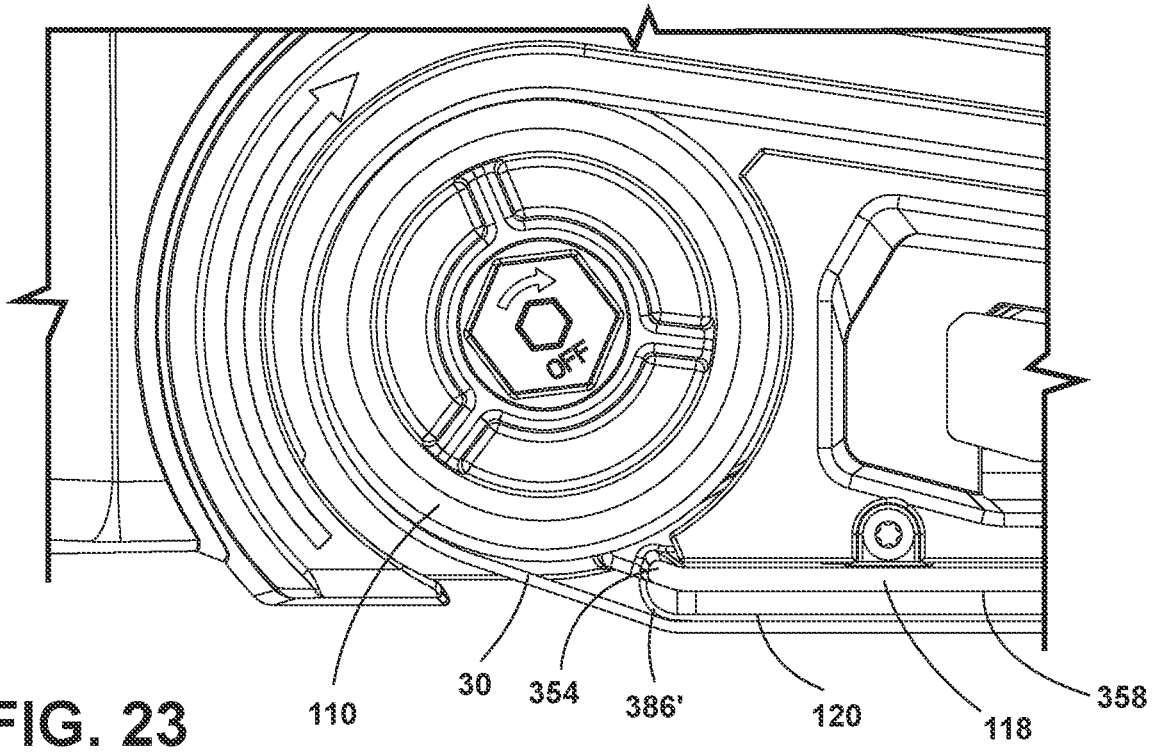
FIG. 23 is a side plan view of a platen attachment in accordance with another embodiment, illustrating the platen attachment coupled to the platen and including a second lip.

FIG. 23 illustrates a second lip 386' in accordance with another embodiment of the platen attachment 120. Here, the second lip 386' bends along a continuous arc defining a constant radius. Specifically, the second lip 386' extends beyond the rear edge 354 of the platen 118 and bends above at least a portion of the bottom side 358 of the platen 118. A single line may extend between the second lip 386' and the drive wheel 110 that is tangential to both the second lip 386' and the drive wheel 110. The second lip 386' decreases wear rates of the sanding belt 30 and decreases temperature generation between the platen attachment 120 and the sanding belt 30.

Figure 19:
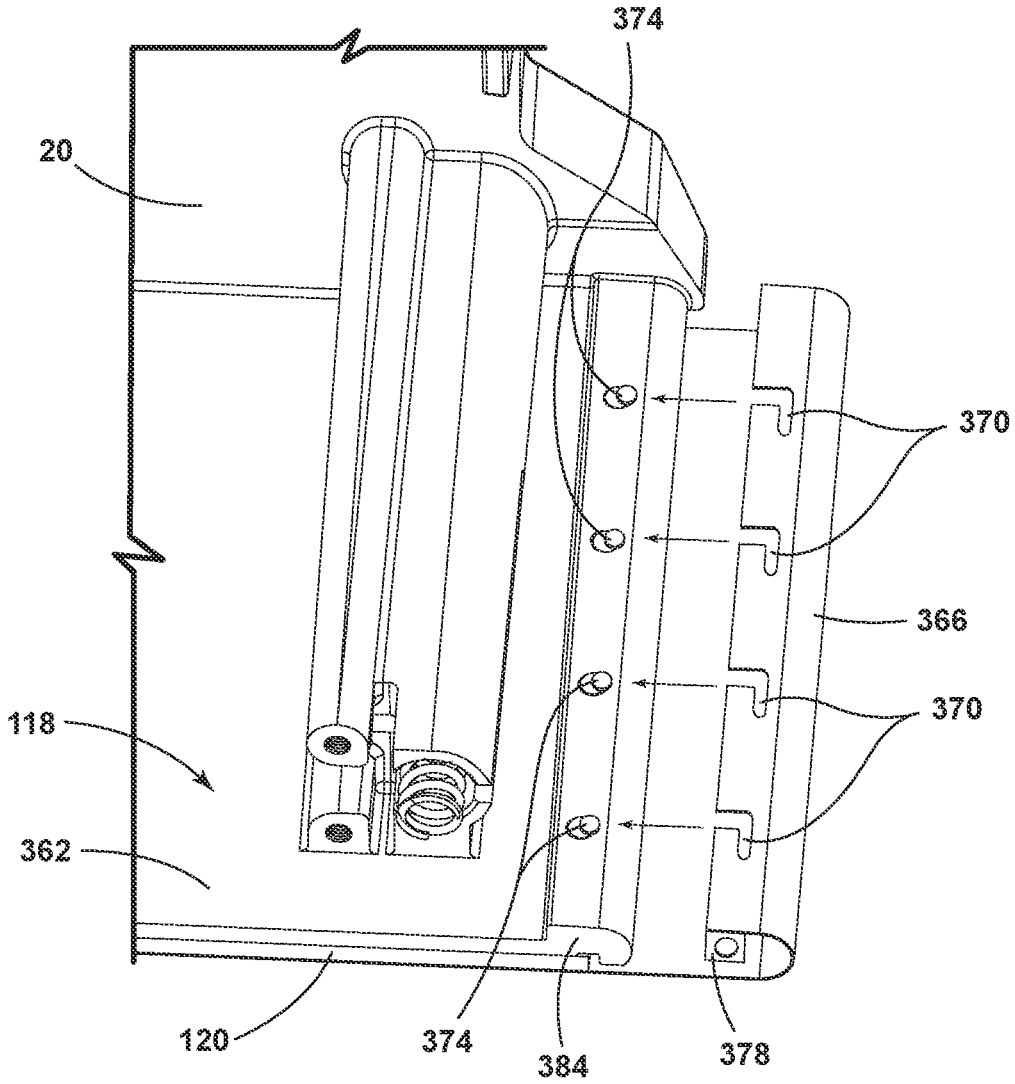
FIG. 19 is a perspective view of the platen attachment of FIG. 17 during assembly to the platen, illustrating the plurality of slots aligned with a plurality of pins of the platen.
Figure 20:
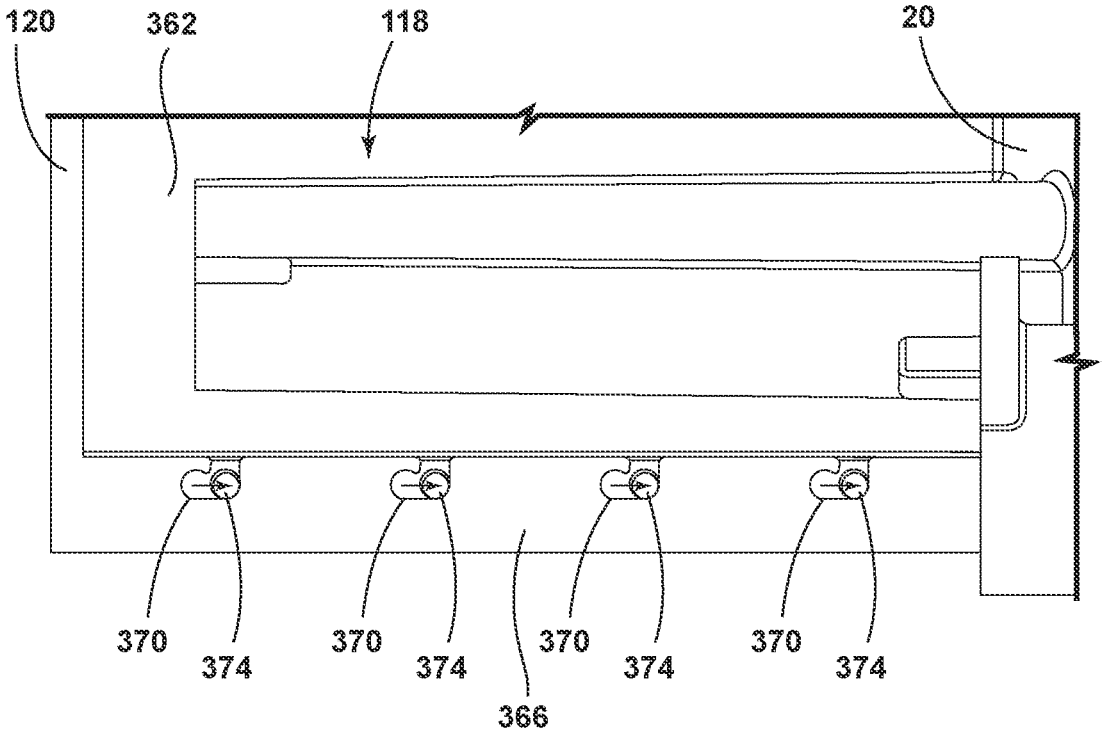
FIG. 20 is a top plan view of the platen attachment during assembly to the platen, illustrating the plurality of pins received within the plurality of slots.
Figure 21:
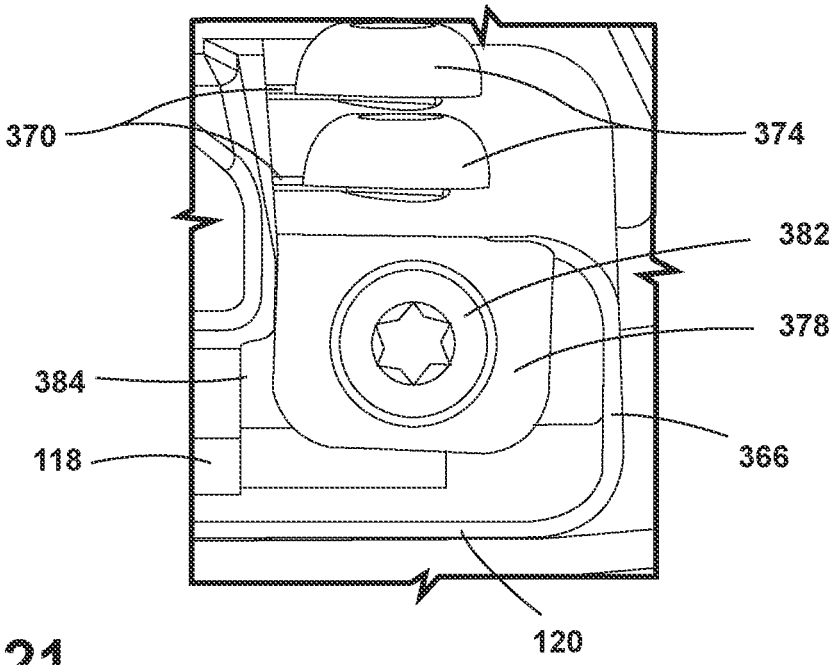
FIG. 21 is a side perspective view of the platen attachment, illustrating the platen attachment coupled to the platen via a fastener extending through a portion of the platen attachment.

During assembly of the platen attachment 120 to the platen 118, a user simply engages the platen attachment 120 with the bottom side 358 of the platen 118, where the first lip 366 is disposed forward of the front edge 350, as shown in FIG. 19. At this point, the user aligns the plurality of slots 370 with the plurality of pins 374 and slides the platen attachment 120 rearward towards the drive wheel 110 (FIG. 19). As a result, the plurality of pins 374 are received within the leg of slots 370 that extends perpendicular to the driven wheel axis 130 (FIG. 20). Subsequently, a user slides the platen attachment 120 in a direction parallel to the drive wheel axis 130, such that the plurality of pins 374 are received within the leg of the slots 370 that extends parallel to the driven wheel axis 130. Now, the tab 378 abuts the sidewall 384 of the platen 118, where the fastener 382 can be threaded into the sidewall 384 of the platen 118 to rigidly couple the platen attachment 120 to the platen 118. In other words, the platen attachment 120 is inhibited from moving relative to the platen 118, until the fastener 382 is removed.

Figure 24:
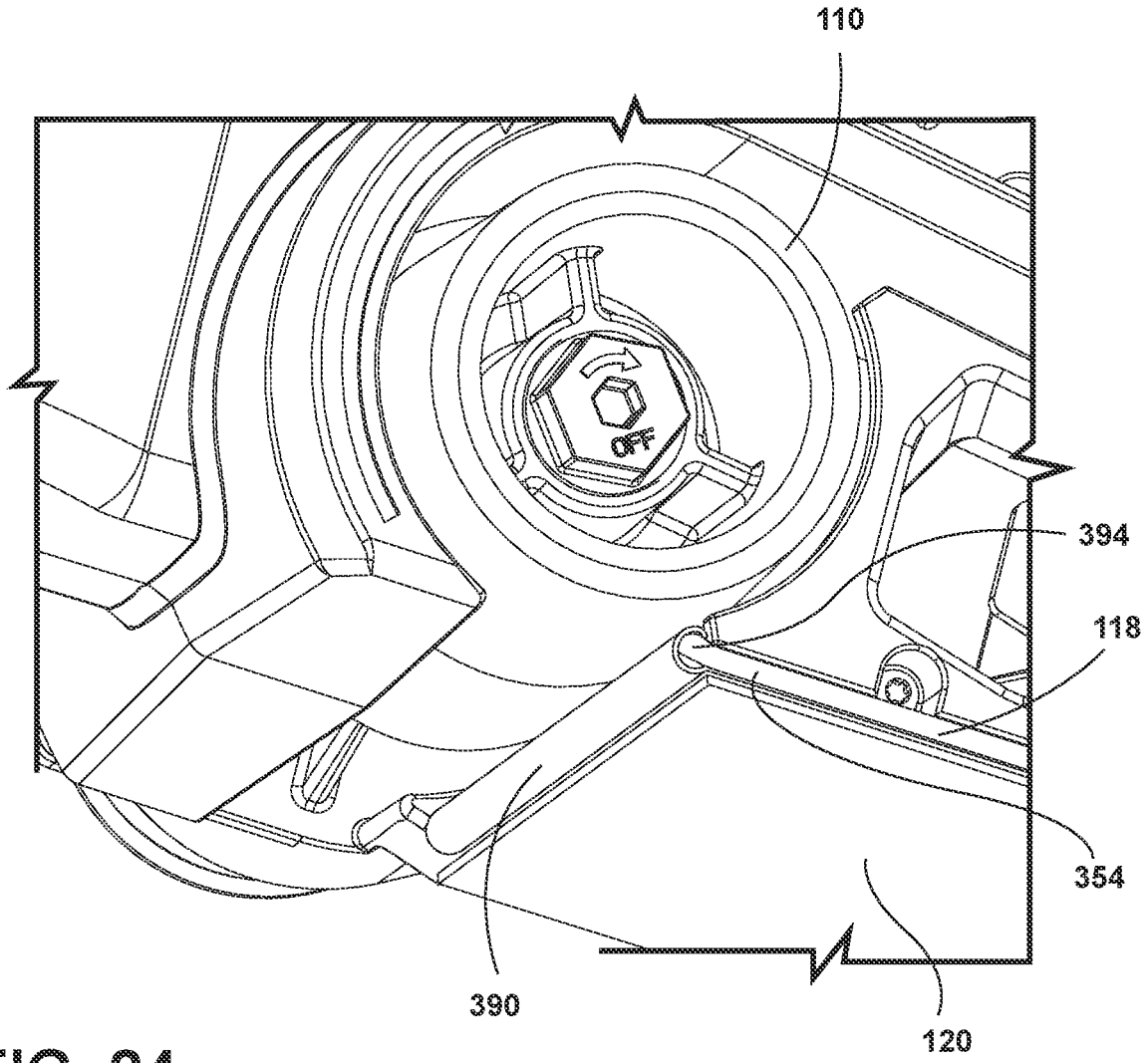
FIG. 24 is a rear perspective view of belt sander of FIG. 1, illustrating a wear skid removably coupled to the platen.
Figure 25:
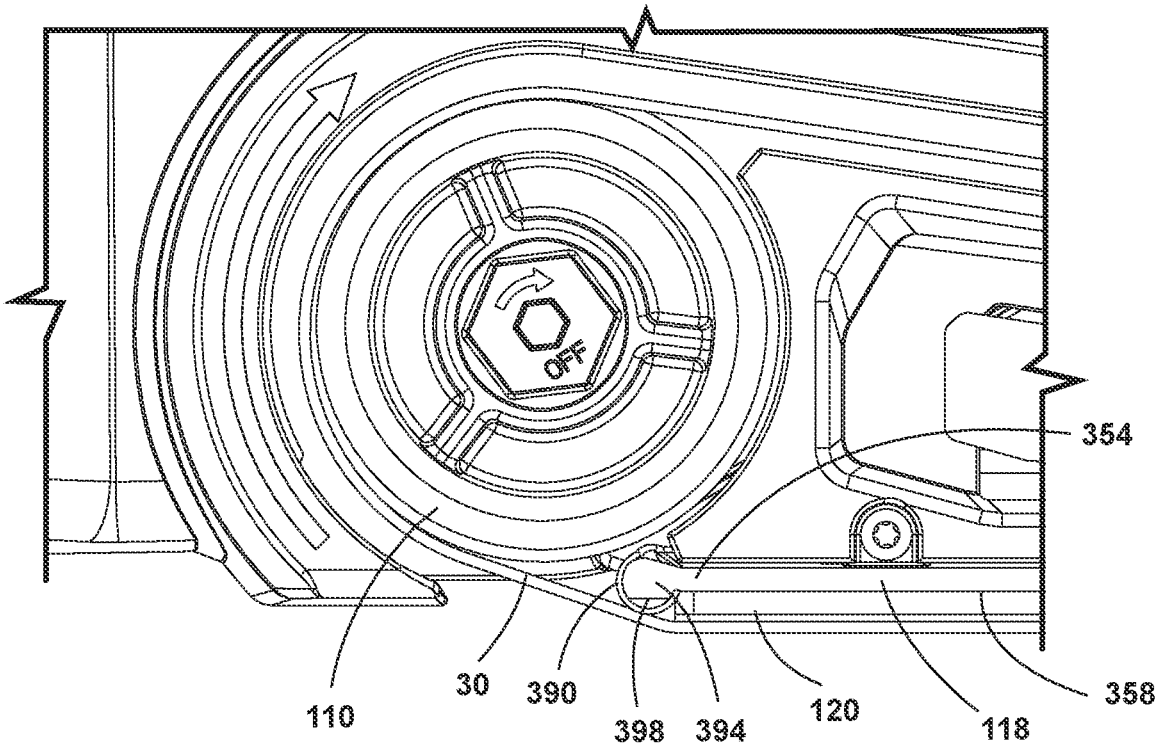
FIG. 25 is a side plan view of the belt sander of FIG. 1, illustrating the wear skid coupled to an enlarged head of the platen.

With reference to FIGS. 24 and 25, the belt sander 10 may further include a wear skid 390 removably coupled to the rear edge 354 of the platen 118. Specifically, the wear skid 390 protrudes beyond the platen attachment 120 and extends into the path of the sanding belt 30 to provide a more gradual transition to the sanding belt 30 between the platen attachment 120 and the drive wheel 110. As a result, the sanding belt 30 is prevented from rubbing against the rear edge 354 of the platen 118, which may otherwise occur in absence of the wear skid 390, which may cause premature wear of the sanding belt 30.

With continued reference to FIGS. 24 and 25, the wear skid 390 defines a continuous arc defining a constant radius and extends across the entire width of the platen 118. The wear skid 390 is coupled to an enlarged head 394 of the platen 118. The enlarged head 394 includes a notch 398 to facilitate assembly of the wear skid 390 onto the enlarged head 394 and facilitate heat transfer away from the wear skid 390. In some embodiments, the wear skid 390 is composed of 1080 steel and includes the nitride surface coating to decrease the coefficient of friction between the wear skid 390 and the sanding belt 30. In other embodiments, the wear skid 390 may alternatively be composed of a ceramic material. Although not illustrated, the wear skid 390 may alternatively be a rolling element that rotates in response to engagement with the sanding belt 30 as the sanding belt 30 is being driven.

Although the invention has been described in detail with reference to certain preferred embodiments, variations and modifications exist within the scope and spirit of one or more independent aspects of the invention as described.

Various features and advantages of the invention are set forth in the following claims.

What is claimed is:

1. A belt sander for sanding a workpiece and defining a center of gravity within a first plane, the belt sander comprising:

a main housing;

a handle defining a second plane;

a drive unit disposed within the main housing, the drive unit including a motor disposed adjacent a first lateral sidewall of the main housing, a pulley system disposed adjacent a second lateral sidewall of the main housing opposite the first lateral sidewall, and a planetary gear transmission disposed between the motor and the pulley system; and a belt drive system driven by the drive unit, the belt drive system including a drive wheel that is driven by the pulley system, a driven wheel that is driven by the drive wheel via a sanding belt, and a platen disposed between the drive wheel and the driven wheel to press the sanding belt against a workpiece, wherein the platen defines a third plane extending perpendicular therefrom, wherein the planetary gear transmission and pulley system are disposed on one side of the first plane and the motor is disposed on an opposite side of the first plane, and wherein the motor is intersected by the second plane and the third plane, and a drive shaft that provides a rotational input to the planetary gear transmission, and an output shaft that is driven by the planetary gear transmission and provides a rotational input to the pulley system, wherein the drive shaft, the planetary gear transmission, and the output shaft are coaxial.

2. The belt sander of claim 1, wherein the planetary gear transmission is disposed adjacent the second lateral sidewall.

3. The belt sander of claim 1, wherein the first plane is disposed between the motor and the planetary gear transmission.

4. The belt sander of claim 1, wherein the first plane is approximately equal distance from the first lateral sidewall and the second lateral sidewall.

5. The belt sander of claim 1, wherein the first plane, the second plane, and the third plane are all parallel to each other and perpendicular relative to the platen.

6. The belt sander of claim 1, wherein the main housing includes a first clamshell half, a second clamshell half, and a joint along which the first and second clamshell halves are joined, and wherein the second plane is coplanar with the joint.

7. The belt sander of claim 1, wherein the first plane is closer to the second plane than the third plane.

8. The belt sander of claim 1, wherein the handle is a first handle, and wherein the belt sander further includes a second handle movably coupled to the main housing and a lock system to selectively secure the second handle relative to the main housing.

9. The belt sander of claim 8, wherein the lock system is pivotable between a locked state, in which the second handle is inhibited from moving relative to the main housing, and an unlocked state, in which the second handle is permitted to move relative to the main housing.

10. The belt sander of claim 8, wherein the main housing includes a rail along which the second handle is slidable along a rail axis.

11. The belt sander of claim 10, wherein the second handle is lockable to the rail in two discrete positions.

12. The belt sander of claim 10, wherein the lock system includes an axle received within the second handle, a lever pivotable about the axle to move the lock system between a locked state and an unlocked state, and a cam body coupled to and rotatable by pivoting the lever.

13. The belt sander of claim 12, wherein the cam body is received within a recess in the rail when the lock system is in the locked state, and wherein the cam body is removed from the recess when the lock system is in the unlocked state.

14. The belt sander of claim 13, wherein the cam body mechanically interferes with the recess when the lock system is in the locked state, such that the second handle displaces in a direction perpendicular to the rail axis to maintain frictional contact between a track of the second handle and the rail of the main housing.

15. The belt sander of claim 14, wherein the lock system further includes an elastomeric bushing disposed around the axle, which is compressed when the second handle displaces in a direction perpendicular to the rail axis.

16. The belt sander of claim 12, wherein the lever includes a tip disposed opposite from the cam body that extends beyond the second handle to allow a user to grasp the lever.

17. A belt sander for sanding a workpiece and defining a center of gravity within a first plane, the belt sander comprising:

a main housing;

a first handle defining a second plane;

a second handle movably coupled to the main housing and a lock system to selectively secure the second handle relative to the main housing, the lock system including an axle received within the second handle, a lever pivotable about the axle to move the lock system between a locked state and an unlocked state, and a cam body coupled to and rotatable by pivoting the lever;

a rail disposed on the main housing along which the second handle is slidable along a rail axis;

a drive unit disposed within the main housing, the drive unit including a motor disposed adjacent a first lateral sidewall of the main housing, a pulley system disposed adjacent a second lateral sidewall of the main housing opposite the first lateral sidewall, and a transmission disposed between the motor and the pulley system; and a belt drive system driven by the drive unit, the belt drive system including a drive wheel that is driven by the pulley system, a driven wheel that is driven by the drive wheel via a sanding belt, and a platen disposed between the drive wheel and the driven wheel to press the sanding belt against a workpiece, wherein the platen defines a third plane extending perpendicular therefrom, wherein the transmission and pulley system are disposed on one side of the first plane and the motor is disposed on an opposite side of the first plane, and wherein the motor is intersected by the second plane and the third plane.

* * * * *